US012698613B2

(12) United States Patent
Sugiyama

(10) Patent No.: US 12,698,613 B2
(45) Date of Patent: Aug. 4, 2026

(54) SHOVEL AND CONTROLLER FOR SHOVEL

(71) Applicant: SUMITOMO HEAVY INDUSTRIES, LTD., Tokyo (JP)

(72) Inventor: Yuta Sugiyama, Chiba (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 350 days.

(21) Appl. No.: 17/656,947

(22) Filed: Mar. 29, 2022

(65) Prior Publication Data

US 2022/0220696 A1 Jul. 14, 2022

Related U.S. Application Data

(63) Continuation of application No. PCT/JP2020/037216, filed on Sep. 30, 2020.

(30) Foreign Application Priority Data

Sep. 30, 2019 (JP) ..... 2019-180418

(51) Int. Cl.
*E02F 3/43* (2006.01)

(52) U.S. Cl.
CPC ..... *E02F 3/437* (2013.01)

(58) Field of Classification Search
CPC ..... E02F 3/437; E02F 9/2282; E02F 9/2285; E02F 9/2292; E02F 9/2296; E02F 9/265; E02F 3/439; E02F 9/205; E02F 3/28; E02F 3/36; E02F 3/38; E02F 3/40; E02F 3/435; E02F 3/43; E02F 9/2029; E02F 9/2221; E02F 9/26; B60Y 2200/412
See application file for complete search history.

(56) References Cited

U.S. PATENT DOCUMENTS

2011/0126434 A1* 6/2011 Horton ..... E02F 3/40 37/444
2013/0302124 A1 11/2013 Matsuyama
2016/0017571 A1* 1/2016 Paull ..... E02F 9/2228 701/50
2016/0251835 A1* 9/2016 Kitajima ..... E02F 3/3663 701/50
2019/0106861 A1* 4/2019 Izumi ..... E02F 3/43
2019/0127946 A1 5/2019 Sakai et al.
(Continued)

FOREIGN PATENT DOCUMENTS

JP 851-048503 4/1976
JP H04-044046 2/1992
(Continued)

OTHER PUBLICATIONS

International Search Report for PCT/JP2020/037216 mailed on Dec. 8, 2020.

*Primary Examiner* — Kenneth J Malkowski
*Assistant Examiner* — Ibrahim Abdoalatif Alsomairy
(74) *Attorney, Agent, or Firm* — IPUSA, PLLC

(57) ABSTRACT

A shovel includes an attachment including a boom, an arm, and a bucket and a hardware processor configured to move the attachment to move the working part of the bucket along an intended construction plane. Multiple regions between which a control command for the movement of the bucket generated by the hardware processor differs are set in the vicinity of a bend of the intended construction plane.

11 Claims, 14 Drawing Sheets

(56) References Cited

U.S. PATENT DOCUMENTS

| | | | | |
|---|---|---|---|---|
| 2019/0177948 | A1* | 6/2019 | Matsuyama | E02F 3/437 |
| 2019/0194905 | A1 | 6/2019 | Matsuyama et al. | |
| 2020/0048861 | A1 | 2/2020 | Narikawa et al. | |
| 2021/0230843 | A1* | 7/2021 | Takeuchi | E02F 9/265 |
| 2022/0195702 | A1* | 6/2022 | Ono | E02F 9/2267 |

FOREIGN PATENT DOCUMENTS

| | | |
|---|---|---|
| JP | H09-287165 | 11/1997 |
| JP | 2013-217137 | 10/2013 |
| JP | 2016-106192 | 6/2016 |
| JP | 2018-003514 | 1/2018 |
| JP | 2018-090986 | 6/2018 |
| JP | 2018-090989 | 6/2018 |
| JP | 2018-150771 | 9/2018 |
| WO | 2012/127913 | 9/2012 |

* cited by examiner

SHOVEL AND CONTROLLER FOR SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2020/037216, filed on Sep. 30, 2020 and designating the U.S., which claims priority to Japanese Patent Application No. 2019-180418, filed on Sep. 30, 2019. The entire contents of the foregoing applications are incorporated herein by reference.

BACKGROUND

Technical Field

The present disclosure relates to shovels and controllers for shovels.

Description of Related Art

For shovels, a technique to move a predetermined working part (for example, the teeth tips or back surface) of a bucket along an intended construction plane according as an operator operates an arm has been known.

SUMMARY

According to an aspect of the present invention, a shovel includes an attachment including a boom, an arm, and a bucket and a hardware processor configured to move the attachment to move the working part of the bucket along an intended construction plane. Multiple regions between which a control command for the movement of the bucket generated by the hardware processor differs are set in the vicinity of a bend of the intended construction plane.

DETAILED DESCRIPTION

According to the related-art technique, an intended construction plane constituted of a single plane is a target. Therefore, no consideration is given to the presence of a bend where an inclination discontinuously changes between two planes (contacting planes) in the intended construction plane, such as the intersection of a horizontal plane and a slope in an intended construction plane constituted of the horizontal plane and the slope, for example. Therefore, the shovel may be unable to, for example, make an appropriate transition from the state where the shovel moves the working part of the bucket along the horizontal plane to the state where the shovel moves the working part of the bucket along the slope.

Therefore, it is desired to provide a technique that makes it possible for a shovel to appropriately move the working part of a bucket along an intended construction plane in the vicinity of a bend of the intended construction plane.

According to an embodiment of the present invention, it is possible for a shovel to appropriately move the working part of a bucket along an intended construction plane in the vicinity of a bend of the intended construction plane.

An embodiment of the invention is described below with reference to the drawings.

[Shovel Overview]

Figure 1:
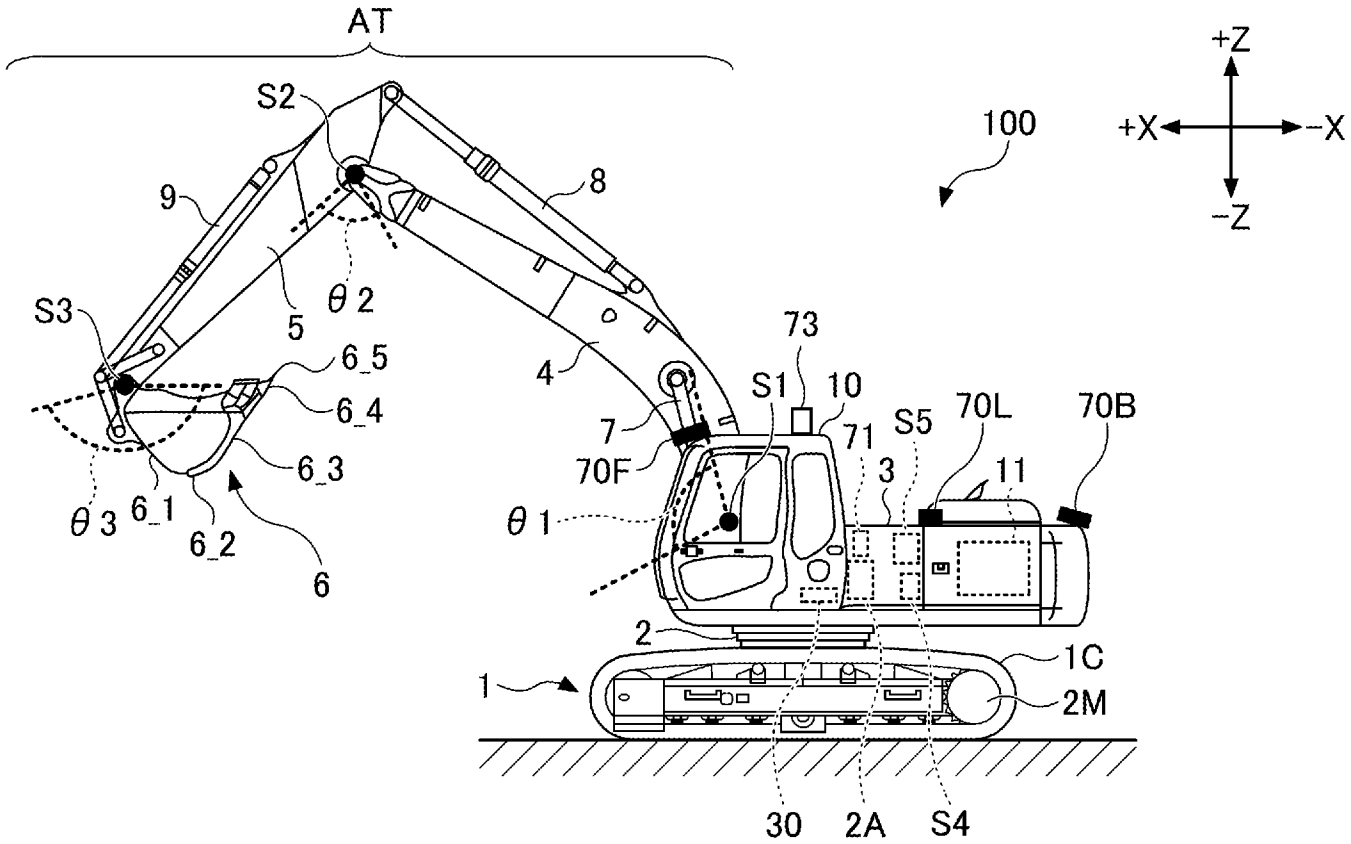
FIG. 1 is a side view of a shovel.
Figure 2:
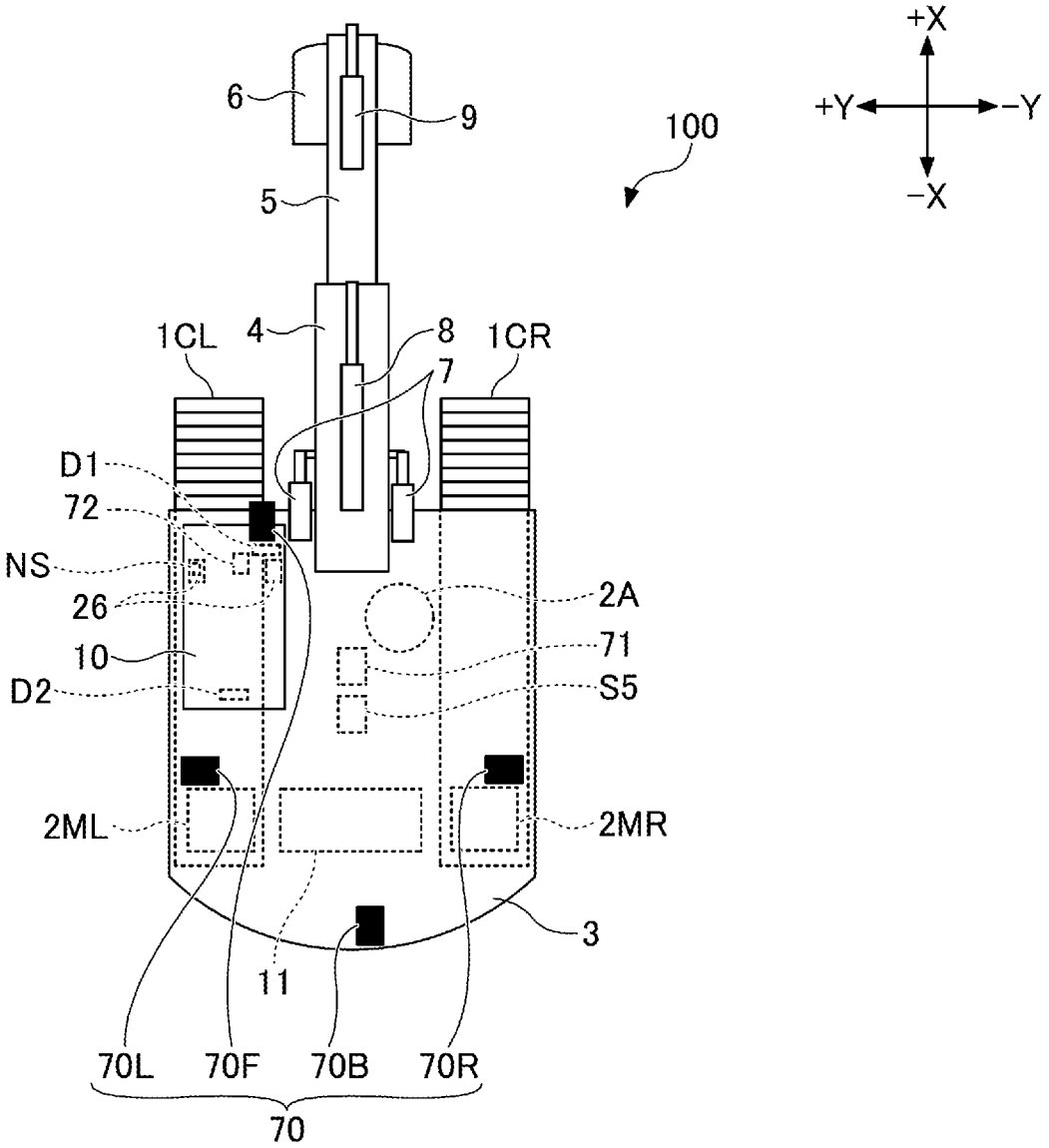
FIG. 2 is a top plan view of the shovel.

First, an overview of a shovel 100 according to this embodiment is given with reference to FIGS. 1 and 2.

FIGS. 1 and 2 are a side view and a top plan view, respectively, of the shovel 100 according to this embodiment.

The shovel 100 according to this embodiment includes a lower traveling structure 1; an upper swing structure 3 swingably mounted on the lower traveling structure 1 via a swing mechanism 2; a boom 4, an arm 5 and a bucket 6 that constitute an attachment AT; and a cabin 10.

As described below, the lower traveling structure 1 includes a pair of left and right crawlers 1C, specifically, a left crawler 1CL and a right crawler 1CR. The left crawler 1CL and the right crawler 1CR are hydraulically driven by travel hydraulic motors 2M (specifically, travel hydraulic motors 2ML and 2MR), so that the lower traveling structure 1 causes the shovel 100 to travel.

The upper swing structure 3 is driven by a swing hydraulic motor 2A to swing relative to the lower traveling structure 1.

The boom 4 is pivotably attached to the front center of the upper swing structure 3 to be movable upward and downward. The arm 5 is pivotably attached to the distal end of the boom 4 to be pivotable upward and downward. The bucket 6 is pivotably attached to the distal end of the arm 5 to be pivotable upward and downward. The boom 4, the arm 5, and the bucket 6 are hydraulically driven by a boom cylinder 7, an arm cylinder 8, and a bucket cylinder 9, respectively, which serve as hydraulic actuators.

The bucket 6 includes a concave bottom plate constituted of an upper surface 6_1, a curved surface 6_2, a back surface 6_3, etc., and a left and a right end plate that close the left end and the right end, respectively, of the bottom plate. The bottom plate and the left and right end plates form an inner space for accommodating earth or the like. Furthermore, multiple teeth 6_4 are provided widthwise (laterally) at the leading edge of the bucket 6 (the back surface 6_3).

The bucket 6 is an example of an end attachment. Instead of the bucket 6, another end attachment, for example, a slope bucket, a dredging bucket, a breaker or the like may be attached to the distal end of the arm 5 in accordance with the contents of work or the like.

The cabin 10 is a cab in which an operator rides, and is mounted on the front left of the upper swing structure 3.

The shovel 100 moves driven elements such as the lower traveling structure 1, the upper swing structure 3, the boom 4, the arm 5, and the bucket 6 in response to operations of the operator riding in the cabin 10. Furthermore, the shovel 100 may move the driven elements such as the lower traveling structure 1, the upper swing structure 3, the boom 4, the arm 5, and the bucket 6 in response to a remote control signal corresponding to the remote control of an operator of a predetermined external apparatus, received from the external apparatus through a communications device.

Furthermore, the shovel 100 implements the function of automatically moving at least one of the driven elements such as the lower traveling structure 1, the upper swing structure 3, the boom 4, the arm 5, and the bucket 6 (hereinafter "automatic operation function").

The automatic operation function may include the function of automatically move a driven element (hydraulic actuator) other than a driven element (hydraulic actuator) to be operated in response to the operator's operation or remote control of an operating device 26 (so-called "semi-automatic operation function" or "machine control function"). Furthermore, the automatic operation function may also include the function of automatically moving at least one of driven elements (hydraulic actuators) without the operator's operation or remote control of the operating device 26 (so-called "fully automatic operation function"). Furthermore, the semi-automatic operation function and the fully automatic operation function may include not only a mode in which the motion details of a driven element (hydraulic actuator) to be automatically operated are automatically determined according to predetermined rules but also a mode in which the shovel 100 autonomously performs various determinations and the motion details of a driven element (hydraulic actuator) to be automatically operated are autonomously determined following the determination results (so-called "autonomous operation function").

[Shovel Configuration]

Next, a configuration of the shovel 100 is described with reference to FIG. 3, FIG. 4 (FIGS. 4A through 4D) and FIG. 5 in addition to FIGS. 1 and 2.

Figure 3:
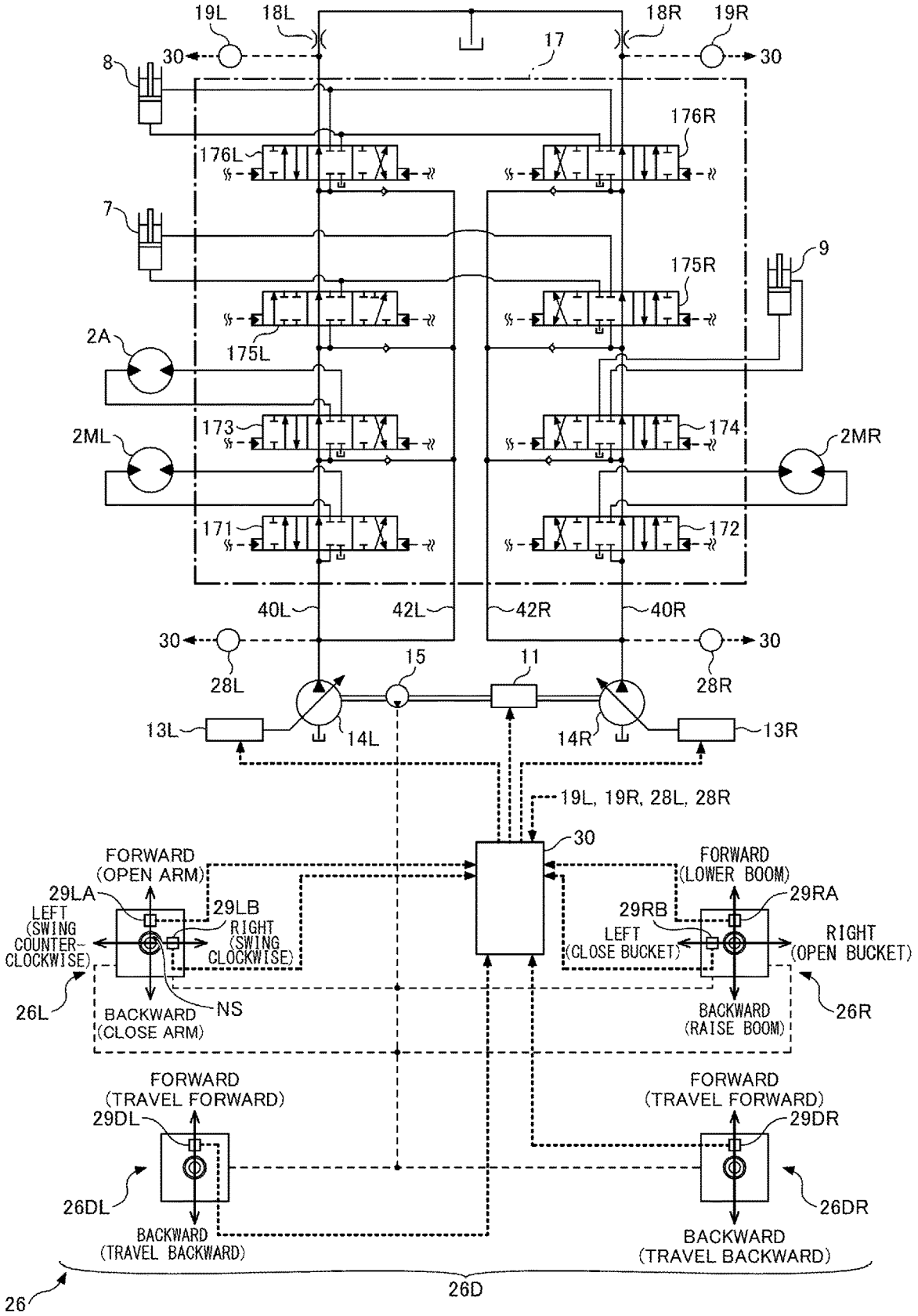
FIG. 3 is a diagram illustrating an example configuration of a hydraulic system of the shovel.

FIG. 3 is a diagram illustrating an example configuration of the hydraulic system of the shovel 100. FIGS. 4A through 4D are diagrams illustrating examples of constituent parts of operation systems associated with the arm 5, the boom 4, the bucket 6, and the upper swing structure 3, respectively, in the hydraulic system of the shovel 100 according to this embodiment. FIG. 5 is a diagram illustrating an example of the operating device 26 of an electric type.

The hydraulic system of the shovel 100 according to this embodiment includes an engine 11, a regulator 13, a main pump 14, a pilot pump 15, a control valve 17, the operating device 26, discharge pressure sensors 28L and 28R, operating pressure sensors 29LA, 29LB, 29RA, 29RB, 29DL, and 29DR, and a controller 30. Furthermore, as described above, the hydraulic system of the shovel 100 according to this embodiment includes hydraulic actuators such as the travel hydraulic motors 2ML and 2MR, the swing hydraulic motor 2A, the boom cylinder 7, the arm cylinder 8, and the bucket cylinder 9 that hydraulically drive the lower traveling structure 1, the upper swing structure 3, the boom 4, the arm 5, and the bucket 6, respectively.

The engine 11 is the main power source of the hydraulic system and is mounted on the back of the upper swing structure 3, for example. Specifically, the engine 11 rotates constantly at a preset target rotational speed under the direct or indirect control of the controller 30 to drive main pumps 14L and 14R and the pilot pump 15. The engine 11 is, for example, a diesel engine fueled with diesel fuel.

Regulators 13L and 13R control the discharge quantities of the main pumps 14L and 14R, respectively. For example, the regulator 13 adjusts the angle (tilt angle) of the swash plate of the main pump 14 in response to a control command from the controller 30.

The main pump 14L and 14R are, for example, mounted on the back of the upper swing structure 3 the same as the engine 11, and as described above, are driven by the engine 11 to supply hydraulic oil to the control valve 17 through a high-pressure hydraulic line. The main pumps 14L and 14R are, for example, variable displacement hydraulic pumps, and their discharge flow rates (discharge pressures) are controlled by the regulator 13 adjusting the tilt angle of the swash plate to adjust a piston stroke length under the control of the controller 30 as described above.

The pilot pump 15 is, for example, mounted on the back of the upper swing structure 3 and supplies a pilot pressure to the operating device 26 via a pilot line. The pilot pump 15 is, for example, a fixed displacement hydraulic pump and is driven by the engine 11 as described above.

The control valve 17 is a hydraulic control device that is mounted in the center of the upper swing structure 3 and controls a hydraulic drive system according to the operator's operation or in response to a control command from the automatic operation function of the shovel 100, for example. As described above, the control valve 17 is connected to the main pump 14 via a high-pressure hydraulic line, and selectively supplies hydraulic oil supplied from the main pump 14 to the hydraulic actuators (the travel hydraulic motors 2ML and 2MR, the swing hydraulic motor 2A, the boom cylinder 7, the arm cylinder 8, and the bucket cylinder 9) in accordance with the operating state of the operating device 26 or in response to a control command from the automatic operation function of the shovel 100. Specifically, the control valve 17 includes control valves 171 through 174, 175L, 175R, 176L and 176R that control the flow rate and flow direction of hydraulic oil supplied from the main pump 14 to the individual hydraulic actuators. Hereinafter, the control valves 175L and 175R may be collectively or individually referred to as the control valve 175. Furthermore, the control valves 176L and 176R may be collectively or individually referred to as the control valve 176.

The control valves 171 and 172 correspond to the travel hydraulic motor 2ML and the travel hydraulic motor 2MR, respectively. The control valve 173 corresponds to the swing hydraulic motor 2A. The control valve 174 corresponds to the bucket cylinder 9. The control valve 175 corresponds to the boom cylinder 7. The control valve 176 corresponds to the arm cylinder 8.

The operating device 26 is provided near the operator seat of the cabin 10 and serves as an operation input device that the operator uses to operate (move) driven elements (such as the lower traveling structure 1, the upper swing structure 3, the boom 4, the arm 5, and the bucket 6). In other words, the operating device 26 is an operation input device that the operator uses to operate (move) hydraulic actuators (namely, the travel hydraulic motors 2ML and 2MR, the swing hydraulic motor 2A, the boom cylinder 7, the arm cylinder 8, the bucket cylinder 9, etc.) that drive corresponding driven elements.

As illustrated in FIGS. 4A through 4D, the operating device 26 is, for example, of a hydraulic pilot type to output a pilot pressure commensurate with its operating state to the secondary side. The operating device 26 is connected to the control valve 17 directly or via a below-described shuttle valve 32 provided in a hydraulic line on its secondary side through the hydraulic line on its secondary side. This allows pilot pressures commensurate with the states of operating the lower traveling structure 1, the upper swing structure 3, the boom 4, the arm 5, the bucket 6, etc., with the operating device 26 to be input to the control valve 17. Therefore, the control valve 17 can drive their respective hydraulic actuators in accordance with the operating states in the operating device 26.

The operating device 26 includes a left operating lever 26L and a right operating lever 26R for operating the attachment AT, namely, the boom 4 (the boom cylinder 7), the arm 5 (the arm cylinder 8), the bucket 6 (the bucket cylinder 9), and the upper swing structure 3. Furthermore, the operating device 26 includes travel levers 26D for operating the lower traveling structure 1. The travel levers 26D include a left travel lever 26DL for operating the left crawler 1CL (the travel hydraulic motor 2ML) and a right travel lever 26DR for operating the right crawler 1CR (the travel hydraulic motor 2MR).

The left operating lever 26L is used to swing the upper swing structure 3 and operate the arm 5. The left operating lever 26L is operated in a forward or a backward direction relative to the operator in the cabin 10 (namely, the forward or the backward direction of the upper swing structure 3) to output a control pressure commensurate with the amount of lever operation (pilot pressure) to a secondary-side pilot line connected to a pilot port of the control valve 176, using hydraulic oil discharged from the pilot pump 15. Furthermore, the left operating lever 26L is operated in a rightward or a leftward direction relative to the operator in the cabin 10 (namely, the rightward or the leftward direction of the upper swing structure 3) to output a control pressure commensurate with the amount of lever operation (pilot pressure) to a secondary-side pilot line connected to a pilot port of the control valve 173, using hydraulic oil discharged from the pilot pump 15.

The right operating lever 26R is used to operate the boom 4 and operate the bucket 6. The right operating lever 26R is operated in the forward or the backward direction relative to the operator in the cabin 10 to output a control pressure commensurate with the amount of lever operation (pilot pressure) to a secondary-side pilot line connected to a pilot port of the control valves 175, using hydraulic oil discharged from the pilot pump 15. Furthermore, the right operating lever 26R is operated in the rightward or the leftward direction to output a control pressure commensurate with the amount of lever operation (pilot pressure) to a secondary-side pilot line connected to the control valve 174, using hydraulic oil discharged from the pilot pump 15.

As described above, the left travel lever 26DL is used to operate the left crawler 1CL, and may be configured to work together with an undepicted left travel pedal. The left travel lever 26DL is operated in the forward or the backward direction relative to the operator in the cabin 10 to output a control pressure commensurate with the amount of lever operation (pilot pressure) to a secondary-side pilot line connected to the control valve 171, using hydraulic oil discharged from the pilot pump 15. The secondary-side pilot lines corresponding to the operations of the left travel lever 26DL in the forward direction and the backward direction may be directly connected to the corresponding pilot ports of the control valve 171. This reflects the operation details of the left travel lever 26DL in the spool position of the control valve 171 that drives the travel hydraulic motor 2ML.

As described above, the right travel lever 26DR is used to operate the right crawler 1CR, and may be configured to work together with an undepicted right travel pedal. The right travel lever 26DR is operated in the forward or the backward direction relative to the operator in the cabin 10 to output a control pressure commensurate with the amount of lever operation (pilot pressure) to a secondary-side pilot line connected to the control valve 172, using hydraulic oil discharged from the pilot pump 15. The secondary-side pilot lines corresponding to the operations of the right travel lever 26DR in the forward direction and the backward direction may be directly connected to the corresponding pilot ports of the control valve 172. That is, the operation details of the right travel lever 26DR are reflected in the spool position of the control valve 172 that drives the travel hydraulic motor 2MR.

Figure 5:
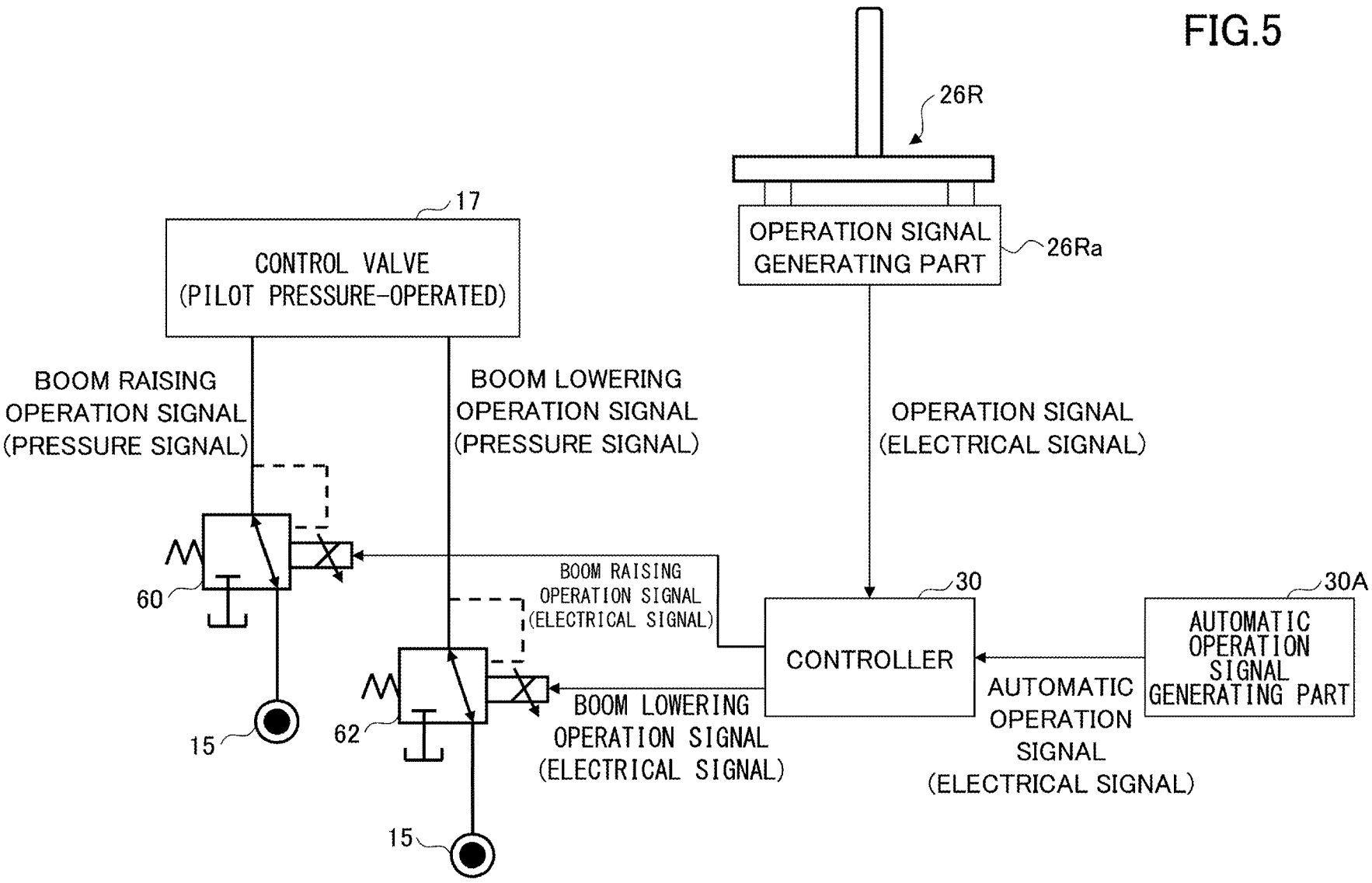
FIG. 5 is a diagram illustrating an example of an electric operating device.

Furthermore, as illustrated in FIG. 5, the operating device 26 (the left operating lever 26L, the right operating lever 26R, the left travel lever 26DL, and the right travel lever 26DR) may be of an electric type that outputs an electrical signal corresponding to its operation details. In this case, an operation signal from the operating device 26 is input to the controller 30, and the controller 30 controls each of the control valves 171 through 176 in the control valve 17 according to the input operation signal, thereby achieving the operations of various hydraulic actuators corresponding to the operation details of the operating device 26. For example, the control valves 171 through 176 in the control valve 17 may be electromagnetic solenoid spool valves that are driven by a command from the controller 30. Furthermore, for example, a hydraulic pressure control valve that operates in response to an electrical signal from the controller 30 (for example, a solenoid proportional valve) (hereinafter, "hydraulic pressure control valve for operation") may be placed between the pilot pump 15 and the pilot ports of each of the control valves 171 through 176. In this case, when the operating device 26 of an electric type is manually operated, the controller 30 can operate each of the control valves 171 through 176 according to the operation details of the operating device 26 by controlling the hydraulic pressure control valve for operation to increase or decrease a pilot pressure, using an electrical signal commensurate with its direction of operation and amount of operation (for example, amount of lever operation).

The pilot circuit of this example (FIG. 5) includes a solenoid valve 60 for the operation of raising the boom 4 (hereinafter "boom raising operation) and a solenoid valve 62 for the operation of lowering the boom 4 (hereinafter "boom lowering operation") as the above-described hydraulic pressure control valve for operation.

The solenoid valve 60 is configured to be able to control the pressure of hydraulic oil in an oil conduit (pilot line) connecting the pilot pump 15 and the boom-raising-side pilot port of the control valve 17 of a pilot pressure-operated type (specifically, the control valves 175L and 175R (see FIG. 3)).

The solenoid valve 62 is configured to be able to control the pressure of hydraulic oil in an oil conduit (pilot line)

connecting the pilot pump 15 and the boom-lowering-side pilot port of the control valve 17 (the control valves 175L and 175R).

When the boom 4 (the boom cylinder 7) is manually operated, the controller 30 generates a boom raising operation signal (electrical signal) or a boom lowering operation signal (electrical signal) in response to an operation signal (electrical signal) output by the right operating lever 26R (an operation signal generating part 26Ra). The operation signal (electrical signal) output from the right operating lever 26R represents its operation details (for example, the amount of operation and the direction of operation). The boom raising operation signal (electrical signal) and the boom lowering operation signal (electrical signal) output by the controller 30 change according to the operation details (the amount of operation and the direction of operation) of the right operating lever 26R.

Specifically, when the right operating lever 26R is operated in a boom raising direction, the controller 30 outputs a boom raising operation signal (electrical signal) commensurate with the amount of operation to the solenoid valve 60. The solenoid valve 60 operates in response to the input electrical signal (boom raising operation signal) to control a pilot pressure applied to the boom-raising-side pilot ports of the control valves 175L and 175R, namely, a boom raising operation signal as a pressure signal. Likewise, when the right operating lever 26R is operated in a boom lowering direction, the controller 30 outputs a boom lowering operation signal (electrical signal) commensurate with the amount of operation to the solenoid valve 62. The solenoid valve 62 operates in response to the input electrical signal (boom lowering operation signal) to control a pilot pressure applied to the boom-lowering-side pilot ports of the control valves 175L and 175R, namely, a boom lowering operation signal as a pressure signal. This enables the control valve 17 to cause the boom cylinder 7 (the boom 4) to move according to the operation details of the right operating lever 26R.

When the boom 4 is automatically operated by the automatic operation function, the controller 30, for example, generates a boom raising operating signal (electrical signal) or a boom lowering operation signal (electrical signal) in response to an automatic operation signal (electrical signal) output by an automatic operation signal generating part 30A. The automatic operation signal may be, for example, either an electrical signal generated by a control device (for example, a control device that controls the automatic operation function) other than the controller 30 as illustrated in FIG. 5 or an electrical signal generated by the controller 30.

The arm 5 (the arm cylinder 8), the bucket 6 (the bucket cylinder 9), the upper swing structure 3 (the swing hydraulic motor 2A), and the lower traveling structure 1 (the travel hydraulic motors 2ML and 2MR), whose movements are based on similar pilot circuits, move the same as the boom 4 (the boom cylinder 7).

The discharge pressure sensors 28L and 28R detect the discharge pressures of the main pumps 14L and 14R, respectively. Detection signals corresponding to the discharge pressures detected by the discharge pressure sensors 28L and 28R are fed into the controller 30.

The operating pressure sensors 29LA, 29LB, 29RA, 29RB, 29DL and 29DR detect the secondary-side pilot pressure of the operating device 26, namely, pilot pressures commensurate with the states of operating corresponding motion elements (namely, hydraulic actuators) with the operating device 26. The detection signals of pilot pressures commensurate with the states of operating the lower traveling structure 1, the upper swing structure 3, the boom 4, the arm 5, the bucket 6, etc., with the operating device 26 generated by the operating pressure sensors 29LA, 29LB, 29RA, 29RB, 29DL and 29DR are fed into the controller 30.

The operating pressure sensor 29LA detects the details (for example, the direction of operation and the amount of operation) of the operator's forward or backward operation on the left operating lever 26L in the form of the pressure of hydraulic oil (hereinafter "operating pressure") in a secondary-side pilot line of the left operating lever 26L.

The operating pressure sensor 29LB detects the details (for example, the direction of operation and the amount of operation) of the operator's rightward or leftward operation on the left operating lever 26L in the form of the operating pressure of a secondary-side pilot line of the left operating lever 26L.

The operating pressure sensor 29RA detects the details (for example, the direction of operation and the amount of operation) of the operator's forward or backward operation on the right operating lever 26R in the form of the operating pressure of a secondary-side pilot line of the right operating lever 26R.

The operating pressure sensor 29RB detects the details (for example, the direction of operation and the amount of operation) of the operator's rightward or leftward operation on the right operating lever 26R in the form of the operating pressure of a secondary-side pilot line of the right operating lever 26R.

The operating pressure sensor 29DL detects the details (for example, the direction of operation and the amount of operation) of the operator's forward or backward operation on the left travel lever 26DL in the form of the operating pressure of a secondary-side pilot line of the left travel lever 26DL.

The operating pressure sensor 29DR detects the details (for example, the direction of operation and the amount of operation) of the operator's forward or backward operation on the right travel lever 26DR in the form of the operating pressure of a secondary-side pilot line of the right travel lever 26DR.

The operation details of the operating device 26 (the left operating lever 26L, the right operating lever 26R, the left travel lever 26DL, and the right travel lever 26DR) may also be detected by sensors other than an operating pressure sensor 29 (for example, potentiometers or the like attached to the left operating lever 26L, the right operating lever 26R, the left travel lever 26DL, and the right travel lever 26DR). Furthermore, when the operating device 26 is of an electric type, the operating pressure sensors 29LA, 29LB, 29RA, 29RB, 29DL and 29DR are omitted.

The controller 30 (an example of a control device) is, for example, provided in the cabin 10, and controls the driving of the shovel 100. The functions of the controller 30 may be implemented by desired hardware or a desired combination of hardware and software. For example, the controller 30 is constituted mainly of a computer that includes a CPU (Central Processing Unit), a memory unit such as a RAM (Random Access Memory), a non-volatile secondary storage such as a ROM (Read Only Memory), and an external input/output interface unit. The controller 30 implements various functions by running various programs stored in the secondary storage on the CPU, for example.

One or more of the functions of the controller 30 may be implemented by another controller (control device). That is, the functions of the controller 30 may be distributed between and implemented by multiple controllers.

As illustrated in FIG. 3, in the hydraulic system of the shovel 100, the part of the hydraulic system of a drive system that drives the hydraulic actuators circulates hydraulic oil from the main pump 14 driven by the engine 11 to a hydraulic oil tank by way of center bypass oil passages 40L and 40R or parallel oil passages 42L and 42R.

The center bypass oil passage 40L starts at the main pump 14L and ends at the hydraulic oil tank, passing through the control valves 171, 173, 175L and 176L, placed in the control valve 17, in order.

The center bypass oil passage 40R starts at the main pump 14R and ends at the hydraulic oil tank, passing through the control valves 172, 174, 175R and 176R, placed in the control valve 17, in order.

The control valve 171 is a spool valve that supplies hydraulic oil discharged from the main pump 14L to the travel hydraulic motor 2ML and discharges hydraulic oil discharged by the travel hydraulic motor 2ML to the hydraulic oil tank.

The control valve 172 is a spool valve that supplies hydraulic oil discharged from the main pump 14R to the travel hydraulic motor 2MR and discharges hydraulic oil discharged by the travel hydraulic motor 2MR to the hydraulic oil tank.

The control valve 173 is a spool valve that supplies hydraulic oil discharged from the main pump 14L to the swing hydraulic motor 2A and discharges hydraulic oil discharged by the swing hydraulic motor 2A to the hydraulic oil tank.

The control valve 174 is a spool valve that supplies hydraulic oil discharged from the main pump 14R to the bucket cylinder 9 and discharges hydraulic oil in the bucket cylinder 9 to the hydraulic oil tank.

The control valves 175L and 175R are spool valves that supply hydraulic oil discharged by the main pumps 14L and 14R to the boom cylinder 7 and discharge hydraulic oil in the boom cylinder 7 to the hydraulic oil tank.

The control valves 176L and 176R are spool valves that supply hydraulic oil discharged by the main pumps 14L and 14R to the arm cylinder 8 and discharge hydraulic oil in the arm cylinder 8 to the hydraulic oil tank.

Each of the control valves 171, 172, 173, 174, 175L, 175R, 176L and 176R controls the flow rate or switches the direction of flow of hydraulic oil discharged from or supplied to a hydraulic actuator according to a pilot pressure applied to its pilot port.

The parallel oil passage 42L supplies hydraulic oil from the main pump 14L to the control valves 173, 175L and 176L in parallel with the center bypass oil passage 40L. Specifically, the parallel oil passage 42L is configured to diverge from the center bypass oil passage 40L upstream of the control valve 171 to make it possible to supply hydraulic oil from the main pump 14L to the control valves 173, 175L and 176L in parallel. This enables the parallel oil passage 42L to supply hydraulic oil to a control valve further downstream when the flow of hydraulic oil through the center bypass oil passage 40L is restricted or blocked by any of the control valves 171, 173 and 175L.

The parallel oil passage 42R supplies hydraulic oil from the main pump 14R to the control valves 174, 175R and 176R in parallel with the center bypass oil passage 40R. Specifically, the parallel oil passage 42R is configured to diverge from the center bypass oil passage 40R upstream of the control valve 172 to make it possible to supply hydraulic oil from the main pump 14R to the control valves 174, 175R and 176R in parallel. This enables the parallel oil passage 42R to supply hydraulic oil to a control valve further downstream when the flow of hydraulic oil through the center bypass oil passage 40R is restricted or blocked by any of the control valves 172, 174 and 175R.

The regulators 13L and 13R control the discharge quantities of the main pumps 14L and 14R by adjusting the tilt angles of the swash plates of the main pumps 14L and 14R, respectively, under the control of the controller 30 as described above.

The discharge pressure sensor 28L detects the discharge pressure of the main pump 14L, and a detection signal corresponding to the detected discharge pressure is fed into the controller 30. The same is true for the discharge pressure sensor 28R. This enables the controller 30 to control the regulators 13L and 13R according to the discharge pressures of the main pump 14L and 14R.

Negative control throttles (hereinafter "NC throttles") 18L and 18R are provided between the most downstream control valves 176L and 176R and the hydraulic oil tank in the center bypass oil passages 40L and 40R, respectively. As a result, the flow of hydraulic oil discharged by the main pumps 14L and 14R is restricted by the NC throttles 18L and 18R. The NC throttles 18L and 18R generate control pressures for controlling the regulators 13L and 13R (hereinafter "NC pressures").

NC pressure sensors 19L and 19R detect the NC pressures of the NC throttles 18L and 18R, respectively, and detection signals corresponding to the detected NC pressures are fed into the controller 30.

The controller 30 may control the regulators 13L and 13R to control the discharge quantities of the main pumps 14L and 14R according to the discharge pressures of the main pumps 14L and 14R detected by the discharge pressure sensors 28L and 28R. For example, according as the discharge pressure of the main pump 14L increases, the controller 30 may reduce the discharge quantity by adjusting the swash plate tilt angle of the main pump 14L by controlling the regulator 13L. The same is true for the regulator 13R. This enables the controller 30 to perform full power control on the main pumps 14L and 14R such that the absorbed power of the main pumps 14L and 14R expressed as the product of discharge pressure and discharge quantity is prevented from exceeding the output power of the engine 11.

Furthermore, the controller 30 may control the discharge quantities of the main pumps 14L and 14R by controlling the regulators 13L and 13R according to the NC pressures detected by the NC pressure sensors 19L and 19R. For example, the controller 30 reduces the discharge quantities of the main pumps 14L and 14R as the NC pressures increase and increases the discharge quantities of the main pumps 14L and 14R as the NC pressures decrease.

Specifically, in a standby state where none of the hydraulic actuators is operated in the shovel 100 (the state illustrated in FIG. 3), hydraulic oil discharged from the main pumps 14L and 14R arrives at the NC throttles 18L and 18R through the center bypass oil passages 40L and 40R. The flow of hydraulic oil discharged from the main pumps 14L and 14R increase the NC pressures generated upstream of the NC throttles 18L and 18R. As a result, the controller 30 decreases the discharge quantities of the main pumps 14L and 14R to a minimum allowable discharge quantity to reduce pressure loss (pumping loss) during the passage of the discharged hydraulic oil through the center bypass oil passages 40L and 40R.

In contrast, when any of the hydraulic actuators is operated through the operating device 26, hydraulic oil discharged from the main pump 14L or 14R flows into the operated hydraulic actuator via a control valve corresponding to the operated hydraulic actuator. The same is true for the case where any of the hydraulic actuators is remotely controlled or controlled according to an automatic control function. The flow of hydraulic oil discharged from the main pump 14L or 14R that arrives at the NC throttle 18L or 18R is reduced in amount or lost, so that the NC pressure generated upstream of the NC throttle 18L or 18R is reduced. As a result, the controller 30 can increase the discharge quantity of the main pump 14L or 14R to circulate sufficient hydraulic oil to the operated hydraulic actuator to ensure driving of the operated hydraulic actuator.

Furthermore, as illustrated in FIGS. 3 and 4A through 4D, hydraulic system parts related to operation systems in the hydraulic system of the shovel 100 includes the pilot pump 15, the operating device 26 (the left operating lever 26L, the right operating lever 26R, the left travel lever 26DL, and the right travel lever 26DR), proportional valves 31AL, 31AR, 31BL, 31BR, 31CL, 31CR, 31DL and 31DR, shuttle valves 32AL, 32AR, 32BL, 32BR, 32CL, 32CR, 32DL and 32DR, and pressure reducing proportional valves 33AL, 33AR, 33BL, 33BR, 33CL, 33CR, 33DL and 33DR. Hereinafter, the proportional valves 31AL, 31AR, 31BL, 31BR, 31CL, 31CR, 31DL and 31DR may be collectively or individually referred to as "proportional valve 31." Likewise, the shuttle valves 32AL, 32AR, 32BL, 32BR, 32CL, 32CR, 32DL and 32DR may be collectively or individually referred to as "shuttle valve 32." Likewise, the pressure reducing proportional valves 33AL, 33AR, 33BL, 33BR, 33CL, 33CR, 33DL and 33DR may be collectively or individually referred to as "pressure reducing proportional valve 33."

The proportional valve 31 is provided in a pilot line connecting the pilot pump 15 and the shuttle valve 32, and is configured to be able to change its flow area (a cross-sectional area through which hydraulic oil can pass). The proportional valve 31 operates in response to a control command input from the controller 30. This enables the controller 30 to supply hydraulic oil discharged from the pilot pump 15 to pilot ports of corresponding control valves (specifically, the control valves 173 through 176) in the control valve 17 via the proportional valve 31 and the shuttle valve 32 even when the operating device 26 is not operated by the operator.

The shuttle valve 32 includes two inlet ports and one outlet port, and outputs hydraulic oil having the higher one of pilot pressures input to the two inlet ports to the outlet port. Of the two inlet ports of the shuttle valve 32, one is connected to the operating device 26 and the other is connected to the proportional valve 31. The outlet port of the shuttle valve 32 is connected to a pilot port of a corresponding control valve in the control valve 17 through a pilot line. Therefore, the shuttle valve 32 can apply the higher one of a pilot pressure generated by the operating device 26 and a pilot pressure generated by the proportional valve 31 to a pilot port of a corresponding control valve. According to this, by causing a pilot pressure higher than a secondary-side pilot pressure output from the operating device 26 to be output from the proportional valve 31, the controller 30 can control a corresponding control valve independent of the operator's operation of the operating device 26 to control the movement of the lower traveling structure 1, the upper swing structure 3, or the attachment AT. Therefore, by controlling the proportional valve 31, the controller 30 can cause a hydraulic actuator to perform an operation corresponding to a control command from remote control performed by an operator of an external apparatus or from the automatic operation function.

The pressure reducing proportional valve 33 is provided in a pilot line connecting the operating device 26 and the shuttle valve 32, and is configured to be able to change its flow area. The pressure reducing proportional valve 33 operates in response to a control command input from the controller 30. This enables the controller 30 to force reduction of a pilot pressure output from the operating device 26 (specifically, the left operating lever 26L, the right operating lever 26R, the left travel lever 26DL, or the right travel lever 26DR) when the operating device 26 is operated by the operator. Therefore, even during the operation of the operating device 26, the controller 30 can forcibly control or stop the movement of a hydraulic actuator corresponding to the operation of the operating device 26. Furthermore, for example, even during the operation of the operating device 26, the controller 30 can reduce a pilot pressure output from the operating device 26 to cause the pilot pressure output from the operating device 26 to be lower than a pilot pressure output from the proportional valve 31. Therefore, by controlling the proportional valve 31 and the pressure reducing proportional valve 33, the controller 30 can ensure that a desired pilot pressure is applied to a pilot port of a control valve in the control valve 17 irrespective of the operation details of the operating device 26.

Figure 4A:
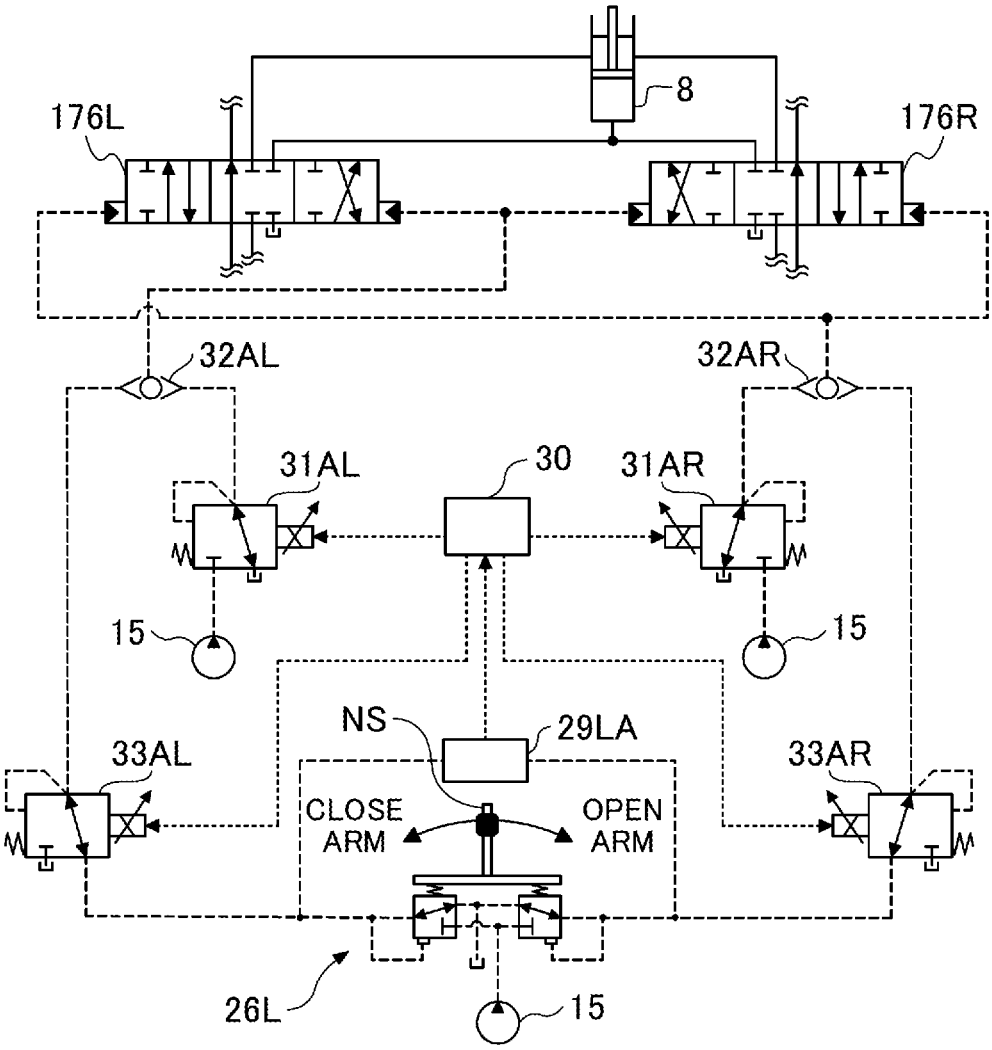
FIG. 4A is a diagram illustrating a constituent part of an operation system associated with an arm in the hydraulic system of the shovel.

As illustrated in FIG. 4A, the left operating lever 26L is used in such a manner as to be tilted forward or backward to operate the arm cylinder 8 corresponding to the arm 5 by the operator. That is, when the left operating lever 26L is tilted forward or backward, the target of operation of the left operating lever 26L is the motion of the arm 5. The left operating lever 26L outputs a pilot pressure commensurate with the details of the forward or the backward operation to a secondary-side pilot line, using hydraulic oil discharged from the pilot pump 15.

The shuttle valve 32AL has two inlet ports: one connected to a secondary-side pilot line of the left operating lever 26L corresponding to an operation in a direction to close the arm 5 (hereinafter "arm closing operation") and the other connected to the secondary-side pilot line of the proportional valve 31AL, and has an outlet port connected to the right pilot port of the control valve 176L and the left pilot port of the control valve 176R.

The shuttle valve 32AR has two inlet ports: one connected to a secondary-side pilot line of the left operating lever 26L corresponding to an operation in a direction to open the arm 5 (hereinafter "arm opening operation") and the other connected to the secondary-side pilot line of the proportional valve 31AR, and has an outlet port connected to the left pilot port of the control valve 176L and the right pilot port of the control valve 176R.

That is, the left operating lever 26L applies a pilot pressure commensurate with the details of the forward or the backward operation to pilot ports of the control valves 176L and 176R through the shuttle valve 32AL or 32AR. Specifically, in response to the arm closing operation, the left operating lever 26L outputs a pilot pressure commensurate with the amount of operation to one inlet port of the shuttle valve 32AL to apply the pilot pressure to the right pilot port of the control valve 176L and the left pilot port of the control valve 176R via the shuttle valve 32AL. Furthermore, in response to the arm opening operation, the left operating lever 26L outputs a pilot pressure commensurate with the amount of operation to one inlet port of the shuttle valve 32AR to apply the pilot pressure to the left pilot port of the control valve 176L and the right pilot port of the control valve 176R via the shuttle valve 32AR.

The proportional valve 31AL operates in response to a control current input from the controller 30. Specifically, the proportional valve 31AL outputs a pilot pressure commensurate with a control current input from the controller 30 to the other inlet port of the shuttle valve 32AL, using hydraulic oil discharged from the pilot pump 15. This enables the proportional valve 31AL to control a pilot pressure applied to the right pilot port of the control valve 176L and the left pilot port of the control valve 176R via the shuttle valve 32AL.

The proportional valve 31AR operates in response to a control current input from the controller 30. Specifically, the proportional valve 31AR outputs a pilot pressure commensurate with a control current input from the controller 30 to the other inlet port of the shuttle valve 32AR, using hydraulic oil discharged from the pilot pump 15. This enables the proportional valve 31AR to control a pilot pressure applied to the left pilot port of the control valve 176L and the right pilot port of the control valve 176R via the shuttle valve 32AR.

That is, the proportional valves 31AL and 31AR can control a pilot pressure output to the secondary side such that the control valves 176L and 176R can stop at a desired valve position independent of the operating state of the left operating lever 26L.

The pressure reducing proportional valve 33AL operates in response to a control current input from the controller 30. Specifically, when no control current is input from the controller 30, the pressure reducing proportional valve 33AL outputs a pilot pressure commensurate with the arm closing operation of the left operating lever 26L directly to the secondary side. In contrast, when a control current is input from the controller 30, the pressure reducing proportional valve 33AL reduces the pilot pressure of a secondary-side pilot line corresponding to the arm closing operation of the left operating lever 26L to an extent corresponding to the control current, and outputs the reduced pilot pressure to the one inlet port of the shuttle valve 32AL. This enables the pressure reducing proportional valve 33AL to forcibly control or stop the operation of the arm cylinder 8 corresponding to the arm closing operation on an as-needed basis even during the arm closing operation of the left operating lever 26L. Furthermore, the pressure reducing proportional valve 33AL can cause a pilot pressure applied to the one inlet port of the shuttle valve 32AL to be lower than a pilot pressure applied to the other inlet port of the shuttle valve 32AL from the proportional valve 31AL even during the arm closing operation of the left operating lever 26L. Therefore, the controller 30 can ensure that a desired pilot pressure is applied to the arm-closing-side pilot ports of the control valves 176L and 176R by controlling the proportional valve 31AL and the pressure reducing proportional valve 33AL.

The pressure reducing proportional valve 33AR operates in response to a control current input from the controller 30. Specifically, when no control current is input from the controller 30, the pressure reducing proportional valve 33AR outputs a pilot pressure commensurate with the arm opening operation of the left operating lever 26L directly to the secondary side. In contrast, when a control current is input from the controller 30, the pressure reducing proportional valve 33AR reduces the pilot pressure of a secondary-side pilot line corresponding to the arm opening operation of the left operating lever 26L to an extent corresponding to the control current, and outputs the reduced pilot pressure to the one inlet port of the shuttle valve 32AR. This enables the pressure reducing proportional valve 33AR to forcibly control or stop the operation of the arm cylinder 8 corresponding to the arm opening operation on an as-needed basis even during the arm opening operation of the left operating lever 26L. Furthermore, the pressure reducing proportional valve 33AR can cause a pilot pressure applied to the one inlet port of the shuttle valve 32AR to be lower than a pilot pressure applied to the other inlet port of the shuttle valve 32AR from the proportional valve 31AR even during the arm opening operation of the left operating lever 26L. Therefore, the controller 30 can ensure that a desired pilot pressure is applied to the arm-opening-side pilot ports of the control valves 176L and 176R by controlling the proportional valve 31AR and the pressure reducing proportional valve 33AR.

Thus, the pressure reducing proportional valves 33AL and 33AR can forcibly control or stop the operations of the arm cylinder 8 corresponding to the forward and the backward operating state of the left operating lever 26L. Furthermore, the pressure reducing proportional valves 33AL and 33AR can assist in ensuring that the pilot pressures of the proportional valves 31AL and 31AR are applied to the pilot ports of the control valves 176L and 176R through the shuttle valves 32AL and 32AR by reducing pilot pressures applied to the one inlet ports of the shuttle valves 32AL and 32AR.

The controller 30 may forcibly control or stop the operation of the arm cylinder 8 corresponding to the arm closing operation of the left operating lever 26L by controlling the proportional valve 31AR instead of controlling the pressure reducing proportional valve 33AL. For example, in the case of performing the arm closing operation with the left operating lever 26L, the controller 30 may control the proportional valve 31AR to act on the arm-opening-side pilot ports of the control valves 176L and 176R from the proportional valve 31AR via the shuttle valve 32AR. This applies a pilot pressure to the arm-opening-side pilot ports of the control valves 176L and 176R against a pilot pressure applied to the arm-closing-side pilot ports of the control valves 176L and 176R from the left operating lever 26L via the shuttle valve 32AL. Therefore, the controller 30 can forcibly move the control valves 176L and 176R toward a neutral position to forcibly control or stop the operation of the arm cylinder 8 corresponding to the arm closing operation of the left operating lever 26L. Likewise, the controller 30 may forcibly control or stop the operation of the arm cylinder 8 corresponding to the arm opening operation of the left operating lever 26L by controlling the proportional valve 31AL instead of controlling the pressure reducing proportional valve 33AR.

The operating pressure sensor 29LA detects the details of the operator's forward or backward operation on the left operating lever 26L in the form of pressure (operating pressure), and a detection signal corresponding to the detected pressure is fed into the controller 30. This enables the controller 30 to determine the details of the forward or the backward operation of the left operating lever 26L. Examples of the details of the forward and the backward operation of the left operating lever 26L to be detected may include the direction of operation and the amount of operation (the angle of operation). Hereinafter, the same applies to the rightward and the leftward operation of the left operating lever 26L and the forward and the backward operation and the rightward and the leftward operation of the right operating lever 26R.

The controller 30 can cause hydraulic oil discharged from the pilot pump 15 to be supplied to the right pilot port of the control valve 176L and the left pilot port of the control valve 176R via the proportional valve 31AL and the shuttle valve 32AL, independent of the operator's arm closing operation on the left operating lever 26L. Furthermore, the controller 30 can cause hydraulic oil discharged from the pilot pump 15 to be supplied to the left pilot port of the control valve 176L and the right pilot port of the control valve 176R via the proportional valve 31AR and the shuttle valve 32AR, independent of the operator's arm opening operation on the left operating lever 26L. That is, the controller 30 can automatically control the opening and closing motion of the arm 5.

Figure 4B:
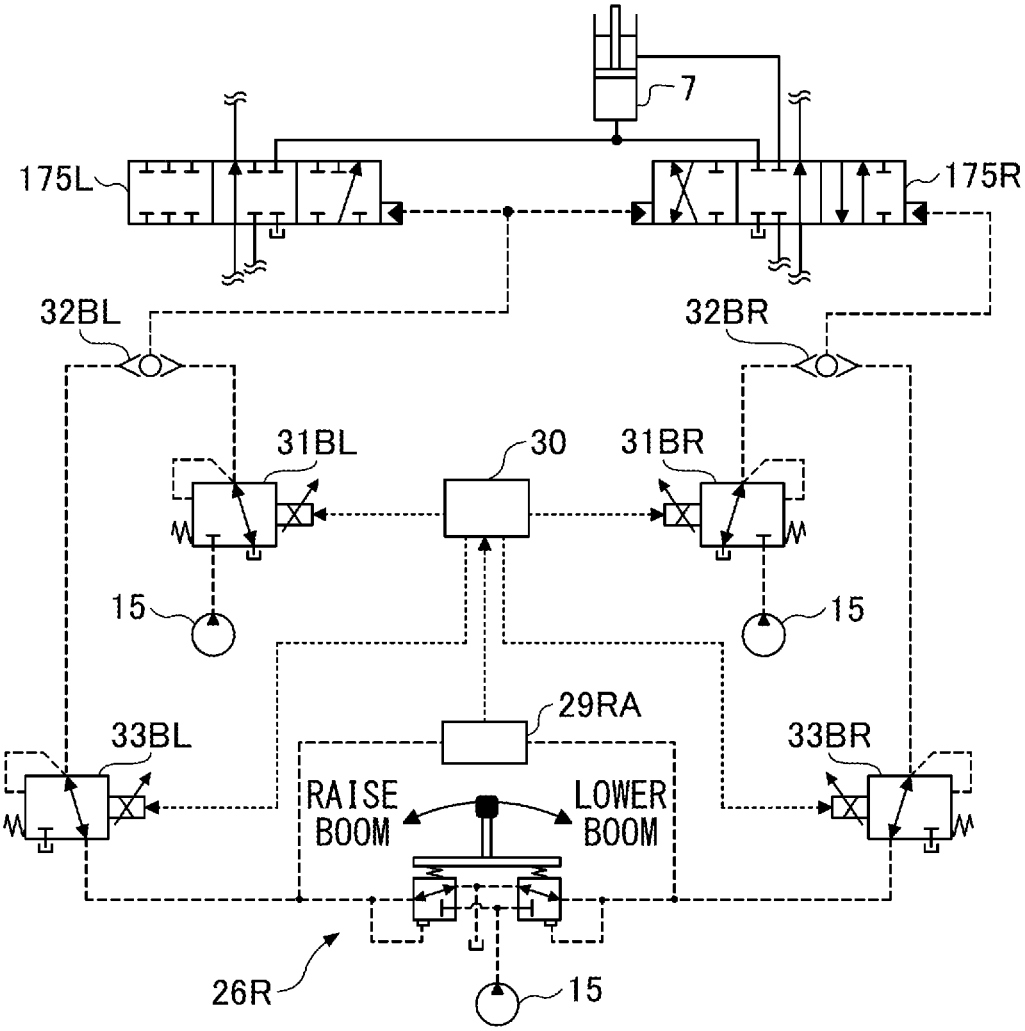
FIG. 4B is a diagram illustrating a constituent part of an operation system associated with a boom in the hydraulic system of the shovel.

Furthermore, for example, as illustrated in FIG. 4B, the right operating lever 26R is used in such a manner as to be tilted forward or backward to operate the boom cylinder 7 corresponding to the boom 4 by the operator. That is, when the right operating lever 26R is tilted forward or backward, the target of operation of the right operating lever 26R is the motion of the boom 4. The right operating lever 26R outputs a pilot pressure commensurate with the details of the forward or the backward operation to the secondary side, using hydraulic oil discharged from the pilot pump 15.

The shuttle valve 32BL has two inlet ports: one connected to a secondary-side pilot line of the right operating lever 26R corresponding to an operation in a direction to raise the boom 4 (hereinafter "boom raising operation") and the other connected to the secondary-side pilot line of the proportional valve 31BL, and has an outlet port connected to the right pilot port of the control valve 175L and the left pilot port of the control valve 175R.

The shuttle valve 32BR has two inlet ports: one connected to a secondary-side pilot line of the right operating lever 26R corresponding to an operation in a direction to lower the boom 4 (hereinafter "boom lowering operation") and the other connected to the secondary-side pilot line of the proportional valve 31BR, and has an outlet port connected to the right pilot port of the control valve 175R.

That is, the right operating lever 26R applies a pilot pressure commensurate with the details of the forward or the backward operation to pilot ports of the control valves 175L and 175R through the shuttle valve 32BL or 32BR. Specifically, in response to the boom raising operation, the right operating lever 26R outputs a pilot pressure commensurate with the amount of operation to one inlet port of the shuttle valve 32BL to apply the pilot pressure to the right pilot port of the control valve 175L and the left pilot port of the control valve 175R via the shuttle valve 32BL. Furthermore, in response to the boom lowering operation, the right operating lever 26R outputs a pilot pressure commensurate with the amount of operation to one inlet port of the shuttle valve 32BR to apply the pilot pressure to the right pilot port of the control valve 175R via the shuttle valve 32BR.

The proportional valve 31BL operates in response to a control current input from the controller 30. Specifically, the proportional valve 31BL outputs a pilot pressure commensurate with a control current input from the controller 30 to the other inlet port of the shuttle valve 32BL, using hydraulic oil discharged from the pilot pump 15. This enables the proportional valve 31BL to control a pilot pressure applied to the right pilot port of the control valve 175L and the left pilot port of the control valve 175R via the shuttle valve 32BL.

The proportional valve 31BR operates in response to a control current input from the controller 30. Specifically, the proportional valve 31BR outputs a pilot pressure commensurate with a control current input from the controller 30 to the other inlet port of the shuttle valve 32BR, using hydraulic oil discharged from the pilot pump 15. This enables the proportional valve 31BR to control a pilot pressure applied to the right pilot port of the control valve 175R via the shuttle valve 32BR.

That is, the proportional valves 31BL and 31BR can control a pilot pressure output to the secondary side such that the control valves 175L and 175R can stop at a desired valve position independent of the operating state of the right operating lever 26R.

The pressure reducing proportional valve 33BL operates in response to a control current input from the controller 30. Specifically, when no control current is input from the controller 30, the pressure reducing proportional valve 33BL outputs a pilot pressure commensurate with the boom raising operation of the right operating lever 26R directly to the secondary side. In contrast, when a control current is input from the controller 30, the pressure reducing proportional valve 33BL reduces the pilot pressure of a secondary-side pilot line corresponding to the boom raising operation of the right operating lever 26R to an extent corresponding to the control current, and outputs the reduced pilot pressure to the one inlet port of the shuttle valve 32BL. This enables the pressure reducing proportional valve 33BL to forcibly control or stop the operation of the boom cylinder 7 corresponding to the boom raising operation on an as-needed basis even during the boom raising operation of the right operating lever 26R. Furthermore, the pressure reducing proportional valve 33BL can cause a pilot pressure applied to the one inlet port of the shuttle valve 32BL to be lower than a pilot pressure applied to the other inlet port of the shuttle valve 32BL from the proportional valve 31BL even during the boom raising operation of the right operating lever 26R. Therefore, the controller 30 can ensure that a desired pilot pressure is applied to the boom-raising-side pilot ports of the control valves 175L and 175R by controlling the proportional valve 31BL and the pressure reducing proportional valve 33BL.

The pressure reducing proportional valve 33BR operates in response to a control current input from the controller 30. Specifically, when no control current is input from the controller 30, the pressure reducing proportional valve 33BR outputs a pilot pressure commensurate with the boom lowering operation of the right operating lever 26R directly to the secondary side. In contrast, when a control current is input from the controller 30, the pressure reducing proportional valve 33BR reduces the pilot pressure of a secondary-side pilot line corresponding to the boom lowering operation of the right operating lever 26R to an extent corresponding to the control current, and outputs the reduced pilot pressure to the one inlet port of the shuttle valve 32BR. This enables the pressure reducing proportional valve 33BR to forcibly control or stop the operation of the boom cylinder 7 corresponding to the boom lowering operation on an as-needed basis even during the boom lowering operation of the right operating lever 26R. Furthermore, the pressure reducing proportional valve 33BR can cause a pilot pressure applied to the one inlet port of the shuttle valve 32BR to be lower than a pilot pressure applied to the other inlet port of the shuttle valve 32BR from the proportional valve 31BR even during the boom lowering operation of the right operating lever 26R. Therefore, the controller 30 can ensure that a desired pilot pressure is applied to the boom-lowering-side pilot ports of the control valves 175L and 175R by controlling the proportional valve 31BR and the pressure reducing proportional valve 33BR.

Thus, the pressure reducing proportional valves 33BL and 33BR can forcibly control or stop the operations of the boom cylinder 7 corresponding to the forward and the backward operating state of the right operating lever 26R. Furthermore, the pressure reducing proportional valves 33BL and 33BR can assist in ensuring that the pilot pressures of the proportional valves 31BL and 31BR are applied to the pilot ports of the control valves 175L and 175R through the shuttle valves 32BL and 32BR by reducing pilot pressures applied to the one inlet ports of the shuttle valves 32BL and 32BR.

The controller 30 may forcibly control or stop the operation of the boom cylinder 7 corresponding to the boom raising operation of the right operating lever 26R by controlling the proportional valve 31BR instead of controlling the pressure reducing proportional valve 33BL. For example, in the case of performing the boom raising operation with the right operating lever 26R, the controller 30 may control the proportional valve 31BR to act on the boom-lowering-side pilot ports of the control valves 175L and 175R from the proportional valve 31BR via the shuttle valve 32BR. This causes a pilot pressure to be applied to the boom-lowering-side pilot ports of the control valves 175L and 175R against a pilot pressure applied to the boom-raising-side pilot ports of the control valves 175L and 175R from the right operating lever 26R via the shuttle valve 32BL. Therefore, the controller 30 can forcibly move the control valves 175L and 175R toward a neutral position to forcibly control or stop the operation of the boom cylinder 7 corresponding to the boom raising operation of the right operating lever 26R. Likewise, the controller 30 may forcibly control or stop the operation of the boom cylinder 7 corresponding to the boom lowering operation of the right operating lever 26R by controlling the proportional valve 31BL instead of controlling the pressure reducing proportional valve 33BR.

The operating pressure sensor 29RA detects the details of the operator's forward or backward operation of the right operating lever 26R in the form of pressure (operating pressure), and a detection signal corresponding to the detected pressure is fed into the controller 30. This enables the controller 30 to determine the details of the forward or the backward operation of the right operating lever 26R.

The controller 30 can cause hydraulic oil discharged from the pilot pump 15 to be supplied to the right pilot port of the control valve 175L and the left pilot port of the control valve 175R via the proportional valve 31BL and the shuttle valve 32BL, independent of the operator's boom raising operation on the right operating lever 26R. Furthermore, the controller 30 can supply hydraulic oil discharged from the pilot pump 15 to the right pilot port of the control valve 175R via the proportional valve 31BR and the shuttle valve 32BR, independent of the operator's boom lowering operation on the right operating lever 26R. That is, the controller 30 can automatically control the rising and lowering motion of the boom 4.

Figure 4C:
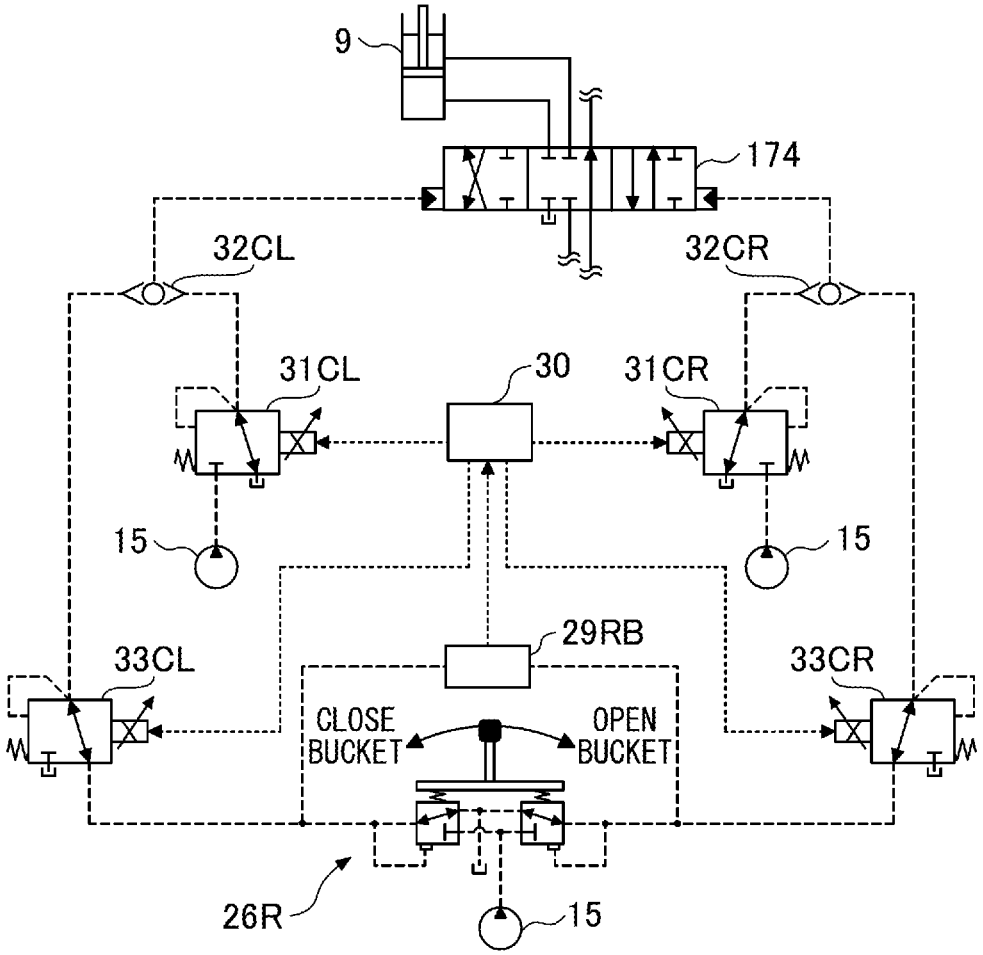
FIG. 4C is a diagram illustrating a constituent part of an operation system associated with a bucket in the hydraulic system of the shovel.

As illustrated in FIG. 4C, the right operating lever 26R is used in such a manner as to be tilted rightward or leftward to operate the bucket cylinder 9 corresponding to the bucket 6 by the operator. That is, when the right operating lever 26R is tilted rightward or leftward, the target of operation of the right operating lever 26R is the motion of the bucket 6. The right operating lever 26R outputs a pilot pressure commensurate with the details of the rightward or the leftward operation to the secondary side, using hydraulic oil discharged from the pilot pump 15.

The shuttle valve 32CL has two inlet ports: one connected to a secondary-side pilot line of the right operating lever 26R corresponding to an operation in a direction to close the bucket 6 (hereinafter "bucket closing operation") and the other connected to the secondary-side pilot line of the proportional valve 31CL, and has an outlet port connected to the left pilot port of the control valve 174.

The shuttle valve 32CR has two inlet ports: one connected to a secondary-side pilot line of the right operating lever 26R corresponding to an operation in a direction to open the bucket 6 (hereinafter "bucket opening operation") and the other connected to the secondary-side pilot line of the proportional valve 31CR, and has an outlet port connected to the right pilot port of the control valve 174.

That is, the right operating lever 26R applies a pilot pressure commensurate with the details of the rightward or the leftward operation to a pilot port of the control valve 174 through the shuttle valve 32CL or 32CR. Specifically, in response to the bucket closing operation, the right operating lever 26R outputs a pilot pressure commensurate with the amount of operation to one inlet port of the shuttle valve 32CL to apply the pilot pressure to the left pilot port of the control valve 174 via the shuttle valve 32CL. Furthermore, in response to the bucket opening operation, the right operating lever 26R outputs a pilot pressure commensurate with the amount of operation to one inlet port of the shuttle valve 32CR to apply the pilot pressure to the right pilot port of the control valve 174 via the shuttle valve 32CR.

The proportional valve 31CL operates in response to a control current input from the controller 30. Specifically, the proportional valve 31CL outputs a pilot pressure commensurate with a control current input from the controller 30 to the other inlet port of the shuttle valve 32CL, using hydraulic oil discharged from the pilot pump 15. This enables the proportional valve 31CL to control a pilot pressure applied to the left pilot port of the control valve 174 via the shuttle valve 32CL.

The proportional valve 31CR operates in response to a control current output by the controller 30. Specifically, the proportional valve 31CR outputs a pilot pressure commensurate with a control current input from the controller 30 to the other inlet port of the shuttle valve 32CR, using hydraulic oil discharged from the pilot pump 15. This enables the proportional valve 31CR to control a pilot pressure applied to the right pilot port of the control valve 174 via the shuttle valve 32CR.

That is, the proportional valves 31CL and 31CR can control a pilot pressure output to the secondary side such that the control valve 174 can stop at a desired valve position independent of the operating state of the right operating lever 26R.

The pressure reducing proportional valve 33CL operates in response to a control current input from the controller 30. Specifically, when no control current is input from the controller 30, the pressure reducing proportional valve 33CL outputs a pilot pressure commensurate with the bucket closing operation of the right operating lever 26R directly to the secondary side. In contrast, when a control current is input from the controller 30, the pressure reducing proportional valve 33CL reduces the pilot pressure of a secondary-side pilot line corresponding to the bucket closing operation of the right operating lever 26R to an extent corresponding to the control current, and outputs the reduced pilot pressure to the one inlet port of the shuttle valve 32CL. This enables the pressure reducing proportional valve 33CL to forcibly control or stop the operation of the bucket cylinder 9 corresponding to the bucket closing operation on an as-needed basis even during the bucket closing operation of the right operating lever 26R. Furthermore, the pressure reducing proportional valve 33CL can cause a pilot pressure applied to the one inlet port of the shuttle valve 32CL to be lower than a pilot pressure applied to the other inlet port of the shuttle valve 32CL from the proportional valve 31CL even during the bucket closing operation of the right operating lever 26R. Therefore, the controller 30 can ensure that a desired pilot pressure is applied to the bucket-closing-side pilot port of the control valve 174 by controlling the proportional valve 31CL and the pressure reducing proportional valve 33CL.

The pressure reducing proportional valve 33CR operates in response to a control current input from the controller 30. Specifically, when no control current is input from the controller 30, the pressure reducing proportional valve 33CR outputs a pilot pressure commensurate with the bucket opening operation of the right operating lever 26R directly to the secondary side. In contrast, when a control current is input from the controller 30, the pressure reducing proportional valve 33CR reduces the pilot pressure of a secondary-side pilot line corresponding to the bucket opening operation of the right operating lever 26R to an extent corresponding to the control current, and outputs the reduced pilot pressure to the one inlet port of the shuttle valve 32CR. This enables the pressure reducing proportional valve 33CR to forcibly control or stop the operation of the bucket cylinder 9 corresponding to the bucket opening operation on an as-needed basis even during the bucket opening operation of the right operating lever 26R. Furthermore, the pressure reducing proportional valve 33CR can cause a pilot pressure applied to the one inlet port of the shuttle valve 32CR to be lower than a pilot pressure applied to the other inlet port of the shuttle valve 32CR from the proportional valve 31CR even during the bucket opening operation of the right operating lever 26R. Therefore, the controller 30 can ensure that a desired pilot pressure is applied to the bucket-opening-side pilot port of the control valve 174 by controlling the proportional valve 31CR and the pressure reducing proportional valve 33CR.

Thus, the pressure reducing proportional valves 33CL and 33CR can forcibly control or stop the operations of the bucket cylinder 9 corresponding to the rightward and the leftward operating state of the right operating lever 26R. Furthermore, the pressure reducing proportional valves 33CL and 33CR can assist in ensuring that the pilot pressures of the proportional valves 31CL and 31CR are applied to the pilot ports of the control valve 174 through the shuttle valves 32CL and 32CR by reducing pilot pressures applied to the one inlet ports of the shuttle valves 32CL and 32CR.

The controller 30 may forcibly control or stop the operation of the bucket cylinder 9 corresponding to the bucket closing operation of the right operating lever 26R by controlling the proportional valve 31CR instead of controlling the pressure reducing proportional valve 33CL. For example, in the case of performing the bucket closing operation with the right operating lever 26R, the controller 30 may control the proportional valve 31CR to act on the bucket-opening-side pilot port of the control valve 174 from the proportional valve 31CR via the shuttle valve 32CR. This applies a pilot pressure to the bucket-opening-side pilot port of the control valve 174 against a pilot pressure acting on the bucket-closing-side pilot port of the control valve 174 from the right operating lever 26R via the shuttle valve 32CL. Therefore, the controller 30 can forcibly move the control valve 174 toward a neutral position to forcibly control or stop the operation of the bucket cylinder 9 corresponding to the bucket closing operation of the right operating lever 26R. Likewise, the controller 30 may forcibly control or stop the operation of the bucket cylinder 9 corresponding to the bucket opening operation of the right operating lever 26R by controlling the proportional valve 31CL instead of controlling the pressure reducing proportional valve 33CR.

The operating pressure sensor 29RB detects the details of the operator's rightward or leftward operation of the right operating lever 26R in the form of pressure (operating pressure), and a detection signal corresponding to the detected pressure is fed into the controller 30. This enables the controller 30 to determine the details of the rightward or the leftward operation of the right operating lever 26R.

The controller 30 can cause hydraulic oil discharged from the pilot pump 15 to be supplied to the left pilot port of the control valve 174 via the proportional valve 31CL and the shuttle valve 32CL, independent of the operator's bucket closing operation on the right operating lever 26R. Furthermore, the controller 30 can cause hydraulic oil discharged from the pilot pump 15 to be supplied to the right pilot port of the control valve 174 via the proportional valve 31CR and the shuttle valve 32CR, independent of the operator's bucket opening operation on the right operating lever 26R. That is, the controller 30 can automatically control the opening and closing motion of the bucket 6.

Figure 4D:
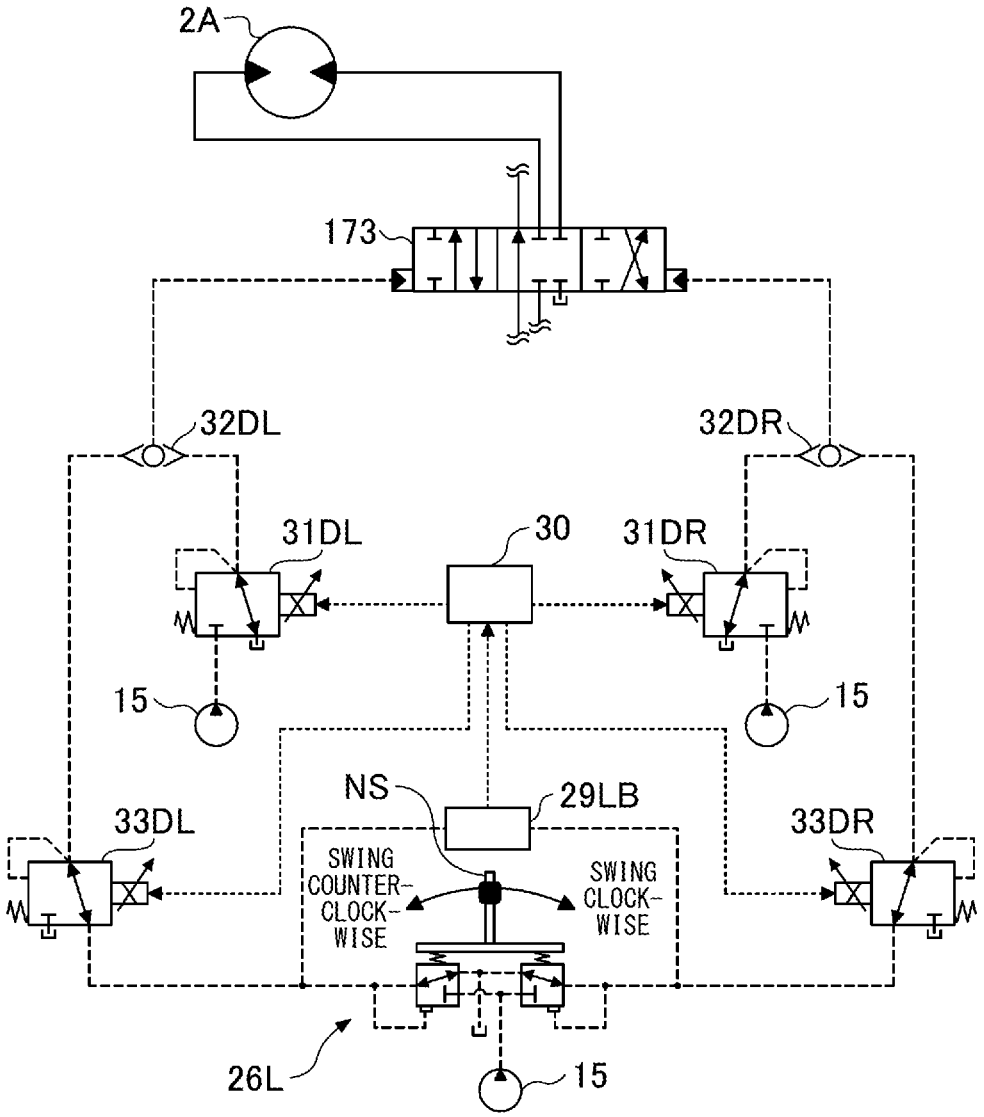
FIG. 4D is a diagram illustrating a constituent part of an operation system associated with an upper swing structure in the hydraulic system of the shovel.

Furthermore, for example, as illustrated in FIG. 4D, the left operating lever 26L is used in such a manner as to be tilted rightward or leftward to operate the swing hydraulic motor 2A corresponding to the upper swing structure 3 (the swing mechanism 2) by the operator. That is, when the left operating lever 26L is tilted rightward or leftward, the target of operation of the left operating lever 26L is the motion of the upper swing structure 3. The left operating lever 26L outputs a pilot pressure commensurate with the details of the rightward or the leftward operation to the secondary side, using hydraulic oil discharged from the pilot pump 15.

The shuttle valve 32DL has two inlet ports: one connected to a secondary-side pilot line of the left operating lever 26L corresponding to an operation to swing the upper swing structure 3 counterclockwise (hereinafter "counterclockwise swing operation") and the other connected to the secondary-side pilot line of the proportional valve 31DL, and has an outlet port connected to the left pilot port of the control valve 173.

The shuttle valve 32DR has two inlet ports: one connected to a secondary-side pilot line of the left operating lever 26L corresponding to an operation to swing the upper swing structure 3 clockwise (hereinafter "clockwise swing operation") and the other connected to the secondary-side pilot line of the proportional valve 31DR, and has an outlet port connected to the right pilot port of the control valve 173.

That is, the left operating lever 26L applies a pilot pressure commensurate with the details of the clockwise or the counterclockwise swing operation to a pilot port of the control valve 173 through the shuttle valve 32DL or 32DR. Specifically, in response to the counterclockwise swing operation, the left operating lever 26L outputs a pilot pressure commensurate with the amount of operation to one inlet port of the shuttle valve 32DL to apply the pilot pressure to the left pilot port of the control valve 173 via the shuttle valve 32DL. Furthermore, in response to the clockwise swing operation, the left operating lever 26L outputs a pilot pressure commensurate with the amount of operation to one inlet port of the shuttle valve 32DR to apply the pilot pressure to the right pilot port of the control valve 173 via the shuttle valve 32DR.

The proportional valve 31DL operates in response to a control current input from the controller 30. Specifically, the proportional valve 31DL outputs a pilot pressure commensurate with a control current input from the controller 30 to the other inlet port of the shuttle valve 32DL, using hydraulic oil discharged from the pilot pump 15. This enables the proportional valve 31DL to control a pilot pressure applied to the left pilot port of the control valve 173 via the shuttle valve 32DL.

The proportional valve 31DR operates in response to a control current output by the controller 30. Specifically, the proportional valve 31DR outputs a pilot pressure commensurate with a control current input from the controller 30 to the other inlet port of the shuttle valve 32DR, using hydraulic oil discharged from the pilot pump 15. This enables the proportional valve 31DR to control a pilot pressure applied to the right pilot port of the control valve 173 via the shuttle valve 32DR.

That is, the proportional valves 31DL and 31DR can control a pilot pressure output to the secondary side such that the control valve 173 can stop at a desired valve position independent of the operating state of the left operating lever 26L.

The pressure reducing proportional valve 33DL operates in response to a control current input from the controller 30. Specifically, when no control current is input from the controller 30, the pressure reducing proportional valve 33DL outputs a pilot pressure commensurate with the counterclockwise swing operation of the left operating lever 26L directly to the secondary side. In contrast, when a control current is input from the controller 30, the pressure reducing proportional valve 33DL reduces the pilot pressure of a secondary-side pilot line corresponding to the counterclockwise swing operation of the left operating lever 26L to an extent corresponding to the control current, and outputs the reduced pilot pressure to the one inlet port of the shuttle valve 32DL. This enables the pressure reducing proportional valve 33DL to forcibly control or stop the operation of the swing hydraulic motor 2A corresponding to the counterclockwise swing operation on an as-needed basis even during the counterclockwise swing operation of the left operating lever 26L. Furthermore, the pressure reducing proportional valve 33DL can cause a pilot pressure applied to the one inlet port of the shuttle valve 32DL to be lower than a pilot pressure applied to the other inlet port of the shuttle valve 32DL from the proportional valve 31DL even during the counterclockwise swing operation of the left operating lever 26L. Therefore, the controller 30 can ensure that a desired pilot pressure is applied to the counterclockwise-swing-side pilot port of the control valve 173 by controlling the proportional valve 31DL and the pressure reducing proportional valve 33DL.

The pressure reducing proportional valve 33DR operates in response to a control current input from the controller 30. Specifically, when no control current is input from the controller 30, the pressure reducing proportional valve 33DR outputs a pilot pressure commensurate with the clockwise swing operation of the left operating lever 26L directly to the secondary side. In contrast, when a control current is input from the controller 30, the pressure reducing proportional valve 33DR reduces the pilot pressure of a secondary-side pilot line corresponding to the clockwise swing operation of the left operating lever 26L to an extent corresponding to the control current, and outputs the reduced pilot pressure to the one inlet port of the shuttle valve 32DR. This enables the pressure reducing proportional valve 33DR to forcibly control or stop the operation of the swing hydraulic motor 2A corresponding to the clockwise swing operation on an as-needed basis even during the clockwise swing operation of the left operating lever 26L. Furthermore, the pressure reducing proportional valve 33DR can cause a pilot pressure applied to the one inlet port of the shuttle valve 32DR to be lower than a pilot pressure applied to the other inlet port of the shuttle valve 32DR from the proportional valve 31DR even during the clockwise swing operation of the left operating lever 26L. Therefore, the controller 30 can ensure that a desired pilot pressure is applied to the clockwise-swing-side pilot port of the control valve 173 by controlling the proportional valve 31DR and the pressure reducing proportional valve 33DR.

Thus, the pressure reducing proportional valves 33DL and 33DR can forcibly control or stop the operations of the swing hydraulic motor 2A corresponding to the rightward and the leftward operating state of the left operating lever 26L. Furthermore, the pressure reducing proportional valves 33DL and 33DR can assist in ensuring that the pilot pressures of the proportional valves 31DL and 31DR are applied to the pilot ports of the control valve 173 through the shuttle valves 32DL and 32DR by reducing pilot pressures acting on the one inlet ports of the shuttle valves 32DL and 32DR.

The controller 30 may forcibly control or stop the operation of the swing hydraulic motor 2A corresponding to the counterclockwise swing operation of the left operating lever 26L by controlling the proportional valve 31DR instead of controlling the pressure reducing proportional valve 33DL. For example, in the case of performing the counterclockwise swing operation with the left operating lever 26L, the controller 30 may control the proportional valve 31DR to act on the clockwise-swing-side pilot port of the control valve 173 from the proportional valve 31DR via the shuttle valve 32DR. This applies a pilot pressure to the clockwise-swing-side pilot port of the control valve 173 against a pilot pressure applied to the counterclockwise-swing-side pilot port of the control valve 173 from the left operating lever 26L via the shuttle valve 32DL. Therefore, the controller 30 can forcibly move the control valve 173 toward a neutral position to forcibly control or stop the operation of the swing hydraulic motor 2A corresponding to the counterclockwise swing operation of the left operating lever 26L. Likewise, the controller 30 may forcibly control or stop the operation of the swing hydraulic motor 2A corresponding to the clockwise swing operation of the left operating lever 26L by controlling the proportional valve 31DL instead of controlling the pressure reducing proportional valve 33DR.

The operating pressure sensor 29LB detects the state of the operator's operation on the left operating lever 26L in the form of pressure, and a detection signal corresponding to the detected pressure is fed into the controller 30. This enables the controller 30 to determine the details of the rightward or the leftward operation of the left operating lever 26L.

The controller 30 can cause hydraulic oil discharged from the pilot pump 15 to be supplied to the left pilot port of the control valve 173 via the proportional valve 31DL and the shuttle valve 32DL, independent of the operator's counterclockwise swing operation on the left operating lever 26L. Furthermore, the controller 30 can cause hydraulic oil discharged from the pilot pump 15 to be supplied to the right pilot port of the control valve 173 via the proportional valve 31DR and the shuttle valve 32DR, independent of the operator's clockwise swing operation on the left operating lever 26L. That is, the controller 30 can automatically control the clockwise and counterclockwise motion of the upper swing structure 3.

A configuration that enables the controller 30 to perform automatic control may also be adopted for the lower traveling structure 1, the same as for the boom 4, the arm 5, the bucket 6, and the upper swing structure 3. In this case, the shuttle valve 32 may be installed in the pilot line between the left travel lever 26DL and the control valve 171 and in the pilot line between the right travel lever 26DR and the control valve 172, and the proportional valve 31 may be installed at the other inlet port of the shuttle valve 32 via a pilot line. According to this, the controller 30 can automatically control the traveling motion of the lower traveling structure 1 (the left crawler 1CL and the right crawler 1CR) by outputting a control current to the proportional valve 31.

Next, the control system of the shovel 100 according to this embodiment includes the controller 30, a space recognition device 70, an orientation detector 71, an input device 72, a positioning device 73, a display device D1, a sound output device D2, a boom angle sensor S1, an arm angle sensor S2, a bucket angle sensor S3, a machine body tilt sensor S4, and a swing state sensor S5.

The space recognition device 70 recognizes an object present in a three-dimensional space surrounding the shovel 100 and obtains information for measuring (calculating) a positional relationship such as the distance from the space recognition device 70 or the shovel 100 to the recognized object. Furthermore, the space recognition device 70 may recognize an object in an area surrounding the shovel 100 and measure the positional relationship between the recognized object and the space recognition device 70 or the shovel 100 based on the obtained information. Examples of the space recognition device 70 may include an ultrasonic sensor, a millimeter wave radar, a monocular camera, a stereo camera, a LIDAR (Light Detecting and Ranging), a distance image sensor, and an infrared sensor. According to this embodiment, the space recognition device 70 includes a forward recognition sensor 70F attached to the front end of the upper surface of the cabin 10, a backward recognition sensor 70B attached to the back end of the upper surface of the upper swing structure 3, a leftward recognition sensor 70L attached to the left end of the upper surface of the upper swing structure 3, and a rightward recognition sensor 70R attached to the right end of the upper surface of the upper swing structure 3. Furthermore, an upward recognition sensor that recognizes an object present in a space above the upper swing structure 3 may be attached to the shovel 100.

The orientation detector 71 detects information on the relative relationship between the orientation of the upper swing structure 3 and the orientation of the lower traveling structure 1 (for example, the swing angle of the upper swing structure 3 relative to the lower traveling structure 1).

The orientation detector 71 may include, for example, a combination of a geomagnetic sensor attached to the lower traveling structure 1 and a geomagnetic sensor attached to the upper swing structure 3. Furthermore, the orientation detector 71 may also include a combination of a GNSS receiver attached to the lower traveling structure 1 and a GNSS receiver attached to the upper swing structure 3. The orientation detector 71 may also include a rotary encoder, a rotary position sensor, etc., that can detect the swing angle of the upper swing structure 3 relative to the lower traveling structure 1, namely, the above-mentioned swing state sensor S5, and may be attached to, for example, a center joint provided in relation to the swing mechanism 2 that achieves relative rotation between the lower traveling structure 1 and the upper swing structure 3. The orientation detector 71 may also include a camera attached to the upper swing structure 3. In this case, the orientation detector 71 performs known image processing on an image captured by the camera attached to the upper swing structure 3 (an input image) to detect an image of the lower traveling structure 1 included in the input image. The orientation detector 71 may identify the longitudinal direction of the lower traveling structure 1 by detecting an image of the lower traveling structure 1 using a known image recognition technique and derive the angle formed between the direction of the longitudinal axis of the upper swing structure 3 and the longitudinal direction of the lower traveling structure 1. At this point, the direction of the longitudinal axis of the upper swing structure 3 may be derived from the attachment position of the camera. In particular, the crawlers 1C protrude from the upper swing structure 3. Therefore, the orientation detector 71 can identify the longitudinal direction of the lower traveling structure 1 by detecting an image of the crawlers 1C.

In the case where the upper swing structure 3 is configured to be driven to swing by an electric motor instead of the swing hydraulic motor 2A, the orientation detector 71 may be a resolver.

The input device 72 is provided within the reach of the operator seated in the cabin 10, and receives the operator's various operation inputs to output signals corresponding to the operation inputs to the controller 30. For example, the input device 72 includes a touchscreen provided on the display of a display device that displays various information images. Furthermore, for example, the input device 72 may include a button switch, a lever, a toggle, etc., provided around the display device D1. Furthermore, the input device 72 may include a knob switch provided on the operating device 26 (for example, a switch NS provided on the left operating lever 26L). A signal corresponding to the details of an operation on the input device 72 is fed into the controller 30.

The switch NS is a push button switch provided at the top of the left operating lever 26L, for example. The operator can operate the left operating lever 26L while pressing the switch NS. The switch NS may also be provided on the right operating lever 26R or at a different position in the cabin 10.

The positioning device 73 measures the position and the orientation of the upper swing structure 3. The positioning device 73 is, for example, a GNSS (Global Navigation Satellite System) compass, and detects the position and the orientation of the upper swing structure 3. A detection signal corresponding to the position and the orientation of the upper swing structure 3 is fed into the controller 30. Furthermore, among the functions of the positioning device 73, the function of detecting the orientation of the upper swing structure 3 may be replaced with a direction sensor attached to the upper swing structure 3.

The display device D1 is provided at such a position as to be easily visible by the operator seated in the cabin 10, and displays various information images under the control of the controller 30. The display device D1 may be connected to the controller 30 via an in-vehicle communications network such as a CAN (Controller Area Network) or may be connected to the controller 30 via a one-to-one dedicated line.

The sound output device D2 is, for example, provided in the cabin 10 and connected to the controller 30 to output a sound under the control of the controller 30. The sound output device D2 is, for example, a loudspeaker or a buzzer. The sound output device D2 outputs various kinds of sound information in response to sound output commands from the controller 30.

The boom angle sensor S1 is attached to the boom 4 to detect the elevation angle of the boom 4 relative to the upper swing structure 3 (hereinafter, "boom angle"), for example, the angle of a straight line connecting the pivot points of the boom 4 at its both ends to the swing plane of the upper swing structure 3 in a side view. Examples of the boom angle sensor S1 may include a rotary encoder, an acceleration sensor, a six-axis sensor, and an IMU (Inertial Measurement Unit), which is hereinafter also the case with the arm angle sensor S2, the bucket angle sensor S3, and the machine body tilt sensor S4. A detection signal corresponding to the boom angle detected by the boom angle sensor S1 is fed into the controller 30.

The arm angle sensor S2 is attached to the arm 5 to detect the pivot angle of the arm 5 relative to the boom 4 (hereinafter "arm angle"), for example, the angle of a straight line connecting the pivot points of the arm 5 at its both ends to the straight line connecting the pivot points of the boom 4 at its both ends in a side view. A detection signal corresponding to the arm angle detected by the arm angle sensor S2 is fed into the controller 30.

The bucket angle sensor S3 is attached to the bucket 6 to detect the pivot angle of the bucket 6 relative to the arm 5 (hereinafter "bucket angle"), for example, the angle of a straight line connecting the pivot point and the leading edge (blade edge) of the bucket 6 to the straight line connecting the pivot points of the arm 5 at its both ends in a side view. A detection signal corresponding to the bucket angle detected by the bucket angle sensor S3 is fed into the controller 30.

The machine body tilt sensor S4 detects the tilt state of the machine body (for example, the upper swing structure 3) relative to a horizontal plane. The machine body tilt sensor S4 is, for example, attached to the upper swing structure 3 to detect the tilt angles of the shovel 100 (namely, the upper swing structure 3) about two axes in its longitudinal direction and lateral direction (hereinafter "longitudinal tilt angle" and "lateral tilt angle"). Examples of the machine body tilt sensor S4 may include an acceleration sensor, a gyroscope (angular velocity sensor), a six-axis sensor, and an IMU. Detection signals corresponding to the tilt angles (longitudinal tilt angle and lateral tilt angle) detected by the machine body tilt sensor S4 are fed into the controller 30.

The swing state sensor S5 is attached to the upper swing structure 3 to output detection information regarding the swing state of the upper swing structure 3. The swing state sensor S5 detects, for example, the swing angular velocity and the swing angle of the upper swing structure 3. Examples of the swing state sensor S5 include a gyroscope, a resolver, and a rotary encoder.

When the machine body tilt sensor S4 includes a gyroscope, a six-axis sensor, an IMU or the like that can detect angular velocities about three axes, the swing state (for example, the swing angular velocity) of the upper swing structure 3 may be detected based on a detection signal of the machine body tilt sensor S4. In this case, the swing state sensor S5 may be omitted.

The controller 30, for example, may perform control related to the hydraulic system of the shovel 100 as described above.

Furthermore, the controller 30, for example, may perform control related to the automatic operation function including the machine guidance function and the machine control function.

Furthermore, the controller 30, for example, may perform control related to the surroundings monitoring function of the shovel 100 based on the output of the space recognition device 70.

For example, the controller 30 monitors the presence or absence of a monitoring object entering an area surrounding the shovel 100 monitored by the space recognition device 70. Specifically, the controller 30 may detect a monitoring object within a predetermined area relative to the shovel 100 (hereinafter, "monitoring area") based on the output of the space recognition device 70. Furthermore, the controller 30 may identify (determine) the type and the position of a monitoring object based on the output of the space recognition device 70, using a known technique such as machine learning. Furthermore, in response to detecting a monitoring object within the monitoring area, the controller 30 may notify the operator and an area surrounding the shovel 100 of the detection of the monitoring target within the monitoring area in a predetermined manner. Furthermore, the controller 30 may notify the operator and the area surrounding the shovel 100 only when the detected monitoring object is determined to be a "person." For example, the operator in the cabin 10 may be notified visually or aurally through the display device D1 or the sound output device D2 (for example, a buzzer or a loudspeaker) in the cabin 10. Furthermore, for example, the area surrounding the shovel 100 may be notified visually or aurally through a sound output device (for example, a buzzer or an alarm) mounted on the upper swing structure 3 or a lighting device (for example, a headlight or a red lamp). Furthermore, for example, a remote control operator may be notified visually or aurally through a sound output device or a display device installed in an external apparatus that assists remote control by transmitting a notification request signal to the external apparatus. Furthermore, in response to detecting a monitoring object within the monitoring area, the controller 30 may restrict the operation of an actuator (driven part) of the shovel 100 in a predetermined manner. Furthermore, the controller 30 may restrict the operation of an actuator (driven part) of the shovel 100 only when the detected monitoring object is determined to be a "person." The restriction of the operation of an actuator includes a control mode that slows the operating speed of an actuator relative to an operation. Furthermore, the restriction of the operation of an actuator includes a control mode that maintains the stationary state of an actuator irrespective of the presence or absence of an operation. For example, the restriction of the operation (the maintenance of the stationary state) of an actuator may be achieved by closing a gate lock valve. Furthermore, when the operating device 26 is an electric type, the controller 30 may achieve the restriction of the operation (the maintenance of the stationary state) of an actuator by disabling an operation signal and outputting no signal to the hydraulic pressure control valve for operation even when the operation signal is input.

Specifically, in response to determining that a person is present within the monitoring area around the shovel 100 before the operator operates the operating device 26, the controller 30 may disable the actuator or cause the actuator to operate very slowly even when the operator operates an operating lever. More specifically, in the case of the operating device 26 of a hydraulic pilot type, in response to determining that a person is present within the monitoring area around the shovel 100, the controller 30 can disable the actuator by putting the gate lock valve in a locking state. In the case of the operating device 26 of an electric type, the controller 30 can disable the actuator by disabling a signal from the controller 30 to a control valve for operation. When it is desired to cause the actuator to operate very slowly, the controller 30 can cause the actuator to operate very slowly by restricting a control signal from the controller 30 to the control valve for operation such that the control signal corresponds to a relatively low pilot pressure. Furthermore, the same applies to the case where the operating device 26 of another type is employed if it is possible to indirectly control a pilot pressure to be applied to a control valve in the control valve 17 using a control valve for operation.

Thus, when it is determined that a monitoring object is present within the monitoring area around the shovel 100, an actuator is prevented from being driven or is driven at a lower operating speed (slower speed) than an operating speed corresponding to an operation input to the operating device 26 even when the operating device 26 is operated. Furthermore, when it is determined that a person is present within the monitoring area around the shovel 100 during the operator's operation of the operating device 26, the operation of an actuator may be stopped or decelerated regardless of the operator's operation. Specifically, in the case of the operating device 26 of a hydraulic pilot type, in response to determining that a person is present within the monitoring area around the shovel 100, the controller 30 stops an actuator by putting the gate lock valve in a locking state. Furthermore, in the case of using a control valve for operation that outputs a pilot pressure corresponding to a control command from the controller 30 to apply the pilot pressure to a pilot port of a corresponding control valve in the control valve 17, the controller 30 can disable an actuator or decelerate its operation by disabling a signal to the control valve for operation or outputting a deceleration command to the control valve for operation.

Furthermore, the same may be true for the case where the shovel 100 is remotely controlled or operated with a complete automatic operation function. That is, when it is determined that a monitoring object is present within the monitoring area around the shovel 100, an actuator may be prevented from being driven or may be driven at a lower operating speed (slower speed) than an operating speed corresponding to an input even when a remote control signal or a control command from the automatic operation function is input.

Furthermore, for example, when the detected monitoring object is a truck, a control as to the stopping or deceleration of an actuator may be prevented from being executed. In this case, the controller 30 may control an actuator to avoid the detected truck.

Thus, the type of a detected monitoring object may be recognized and an actuator may be controlled based on the result of the recognition.

[Overview of Machine Guidance Function and Machine Control Function of Shovel]

Figure 6:
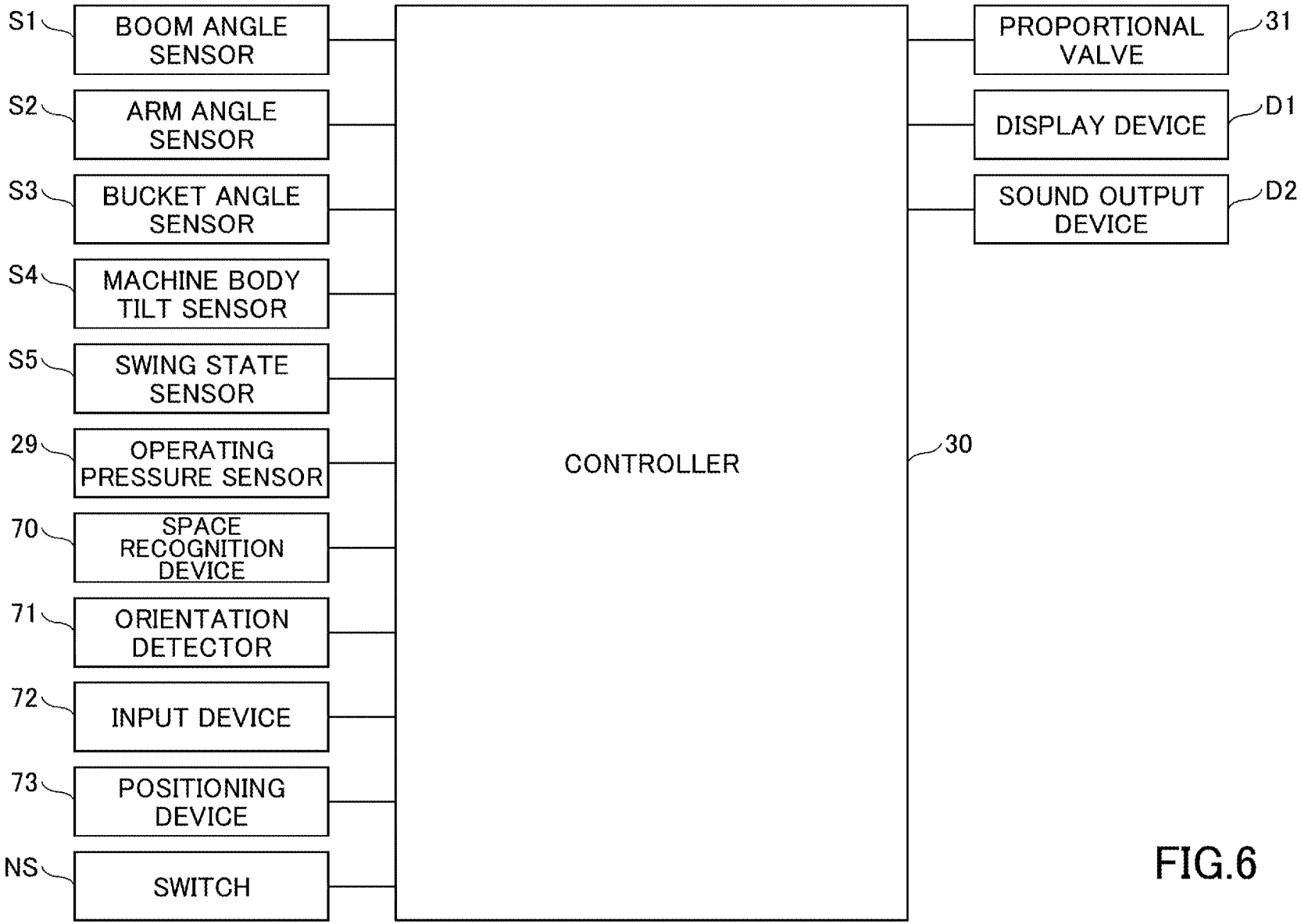
FIG. 6 is a block diagram illustrating an overview of an example of a configuration related to a machine guidance function and a machine control function of the shovel.

Next, an overview of the machine guidance function and the machine control function of the shovel 100 is given with reference to FIG. 6.

FIG. 6 is a block diagram illustrating an overview of an example of a configuration related to the machine guidance function and the machine control function of the shovel 100.

The controller 30, for example, executes a control related to the machine guidance function of the shovel 100 that guides the operator in manually operating the shovel 100.

The controller 30 imparts, for example, work information such as the distance between an intended construction plane and the distal end of the attachment AT, specifically, the working part of the end attachment, to the operator through the display device D1, the sound output device D2, etc. Specifically, the controller 30 obtains information from the boom angle sensor S1, the arm angle sensor S2, the bucket angle sensor S3, the machine body tilt sensor S4, the swing state sensor S5, the space recognition device 70, the positioning device 73, the input device 72, etc. The controller 30 may, for example, calculate the distance between the bucket 6 and the intended construction plane based on the obtained information and impart the calculated distance to the operator through an image displayed on the display device D1 and a sound output from the sound output device D2. Data on the intended construction plane are stored in an internal memory, an external storage connected to the controller 30, or the like, based on settings input through the input device 72 by the operator or by being downloaded from the outside (for example, a predetermined management server). The data on the intended construction plane are expressed in a reference coordinate system. The reference coordinate system is, for example, the world geodetic system. The world geodetic system is a three-dimensional Cartesian coordinate system with the origin at the center of mass of the Earth, the X-axis oriented toward the point of intersection of the prime meridian and the equator, the Y-axis oriented toward 90 degrees east longitude, and the Z-axis oriented toward the Arctic pole. For example, the operator may set any point at a construction site as a reference point and set the intended construction plane based on the relative positional relationship with the reference point through the input device 72. The working part of the bucket 6 is, for example, the teeth tips 6_5 (see FIG. 1) of the bucket 6, the back surface 6_3 of the bucket 6, or the like. Furthermore, for example, when a breaker is employed instead of the bucket 6 as the end attachment, the tip of the breaker corresponds to the working part. This enables the controller 30 to impart work information to the operator through the display device D1, the sound output device D2, etc., to guide the operator in operating the shovel 100 through the operating device 26.

When the shovel 100 is remotely controlled, the work information may be transmitted to an external apparatus that is the transmitter of a remote control signal and be imparted to an operator through a display device and a sound output device installed in the external apparatus. This enables the controller 30 to impart the work information to the operator of the external apparatus to guide the operator in remotely controlling the shovel 100.

Furthermore, the controller 30, for example, executes a control related to the machine control function of the shovel 100 that assists the operator in manually operating the shovel 100. For example, the machine control function is enabled in response to the left operating lever 26L and the right operating lever 26R being operated with the switch NS being pressed. Furthermore, in the case of remotely controlling the shovel 100 as well, the machine control function may be enabled in response to an operating device for remote control (hereinafter "remote controller") used by the operator being operated with a similar knob switch provided on the remote controller being pressed.

The controller 30 is configured to obtain a target for a trajectory (hereinafter "target trajectory") followed by a predetermined part of the attachment that serves as a reference for control (hereinafter simply "control reference"). When there is a target of work that can be contacted by the end attachment (for example, the ground or earth on the bed of a dump truck as described below) as in excavation work, compaction work, etc., the working part of the end attachment (for example, the teeth tips 6_5 or the back surface 6_3 of the bucket 6, the right or left end of the teeth tips 6_5 of the bucket 6, the right or left end of the lower end of the back surface 6_3 of the bottom plate, any point on the curved surface 6_2 of the bottom plate, or the like) may be set as the control reference. Furthermore, in the case of a motion without a target of work that can be contacted by the end attachment, such as a boom raising and swing motion, a dumping motion, or a boom lowering and swing motion as described below, any part that can define the position of the end attachment in the motion (for example, the lower end or the teeth tips 6_5 of the bucket 6) may be set as the control reference. Furthermore, multiple points in the external shape of the bucket 6 corresponding to the working part may be set as the control reference. For example, the controller 30 derives the target trajectory based on data related to the intended construction plane stored in an internal nonvolatile storage or an external nonvolatile storage with which the controller 30 can communicate. The controller 30 may derive the target trajectory based on information on the terrain of an area surrounding the shovel 100 recognized by the space recognition device 70. Furthermore, the controller 30 may derive information on the past trajectory of the working part such as the teeth tips 6_5 of the bucket 6 from the past output of a pose detector (for example, the boom angle sensor S1, the arm angle sensor S2, the bucket angle sensor S3, etc.) temporarily stored in an internal volatile storage and derive the target trajectory based on the information. Furthermore, the controller 30 may derive the target trajectory based on the current position of a predetermined part of the attachment and the data on the intended construction plane.

For example, when the operator is manually performing an operation to excavate or level the ground, the controller 30 automatically moves at least one of the boom 4, the arm 5, and the bucket 6 such that the working part of the bucket 6 (for example, the teeth tips 6_5 or the back surface 6_3 of the bucket 6) coincides with the intended construction plane. Specifically, when the operator operates the left operating lever 26L in a forward or a backward direction while operating (pressing) the switch NS, the controller 30 automatically moves at least one of the boom 4, the arm 5, and the bucket 6 in accordance with the operation such that the working part of the bucket 6 coincides with the intended construction plane. More specifically, the controller 30 controls the proportional valve 31 as described above to automatically move at least one of the boom 4, the arm 5, and the bucket 6. The same applies to the case of remote control. This enables the operator to cause the shovel 100 to perform excavating work, leveling work, etc., along the intended construction plane by merely performing an operation to open or close the arm 5 (for example, by merely operating the left operating lever 26L in a forward or a backward direction).

[Details of Machine Control Function of Shovel]

Next, the machine control function of the shovel 100 according to this embodiment is described in detail with reference to FIGS. 7A and 7B, FIGS. 8A and 8B, and FIG. 9.

<Specific Example of Motion Based on Machine Control Function of Shovel>

Figure 7A:
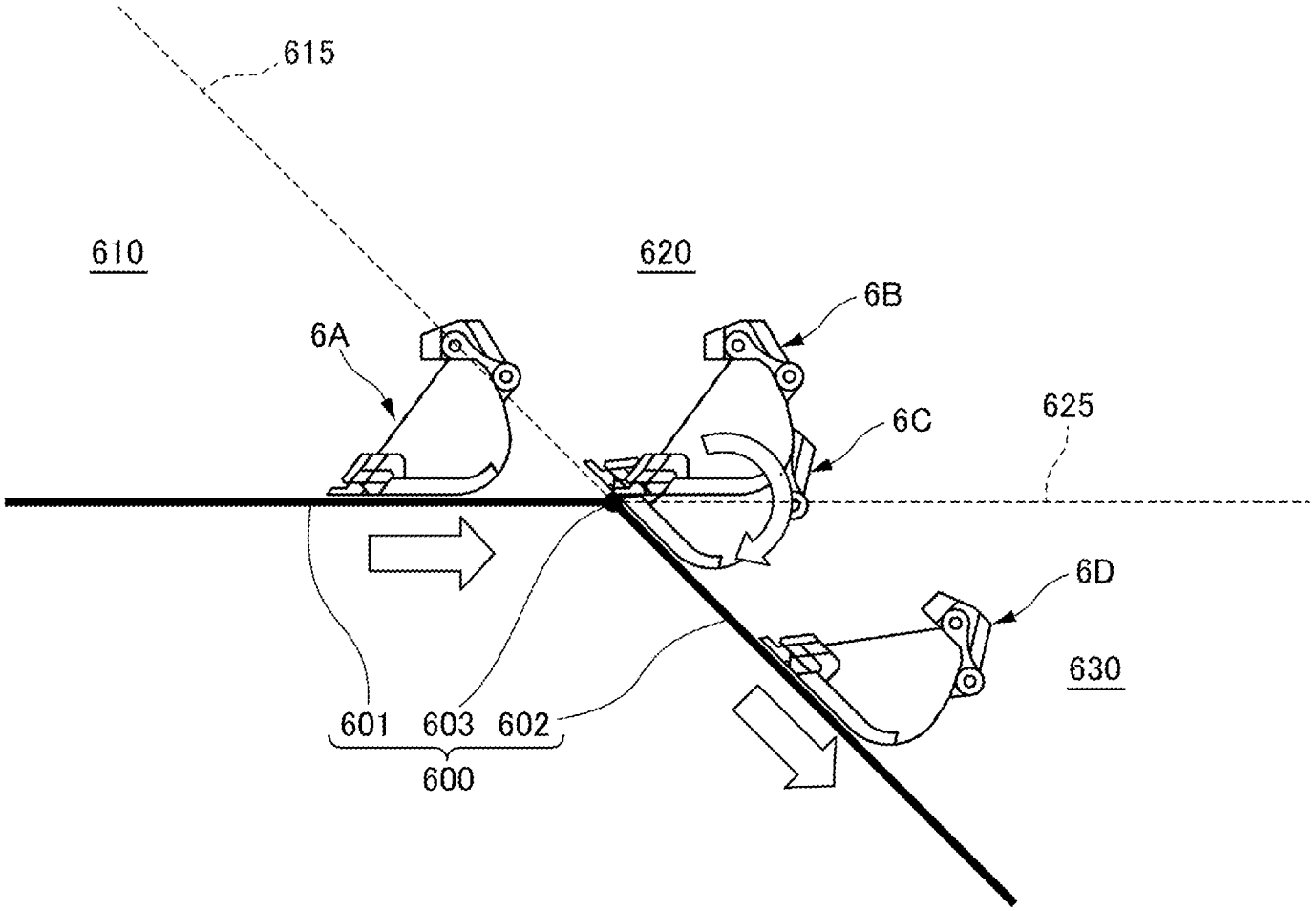
FIG. 7A is a diagram illustrating an example of a motion based on the machine control function of the shovel.
Figure 7B:
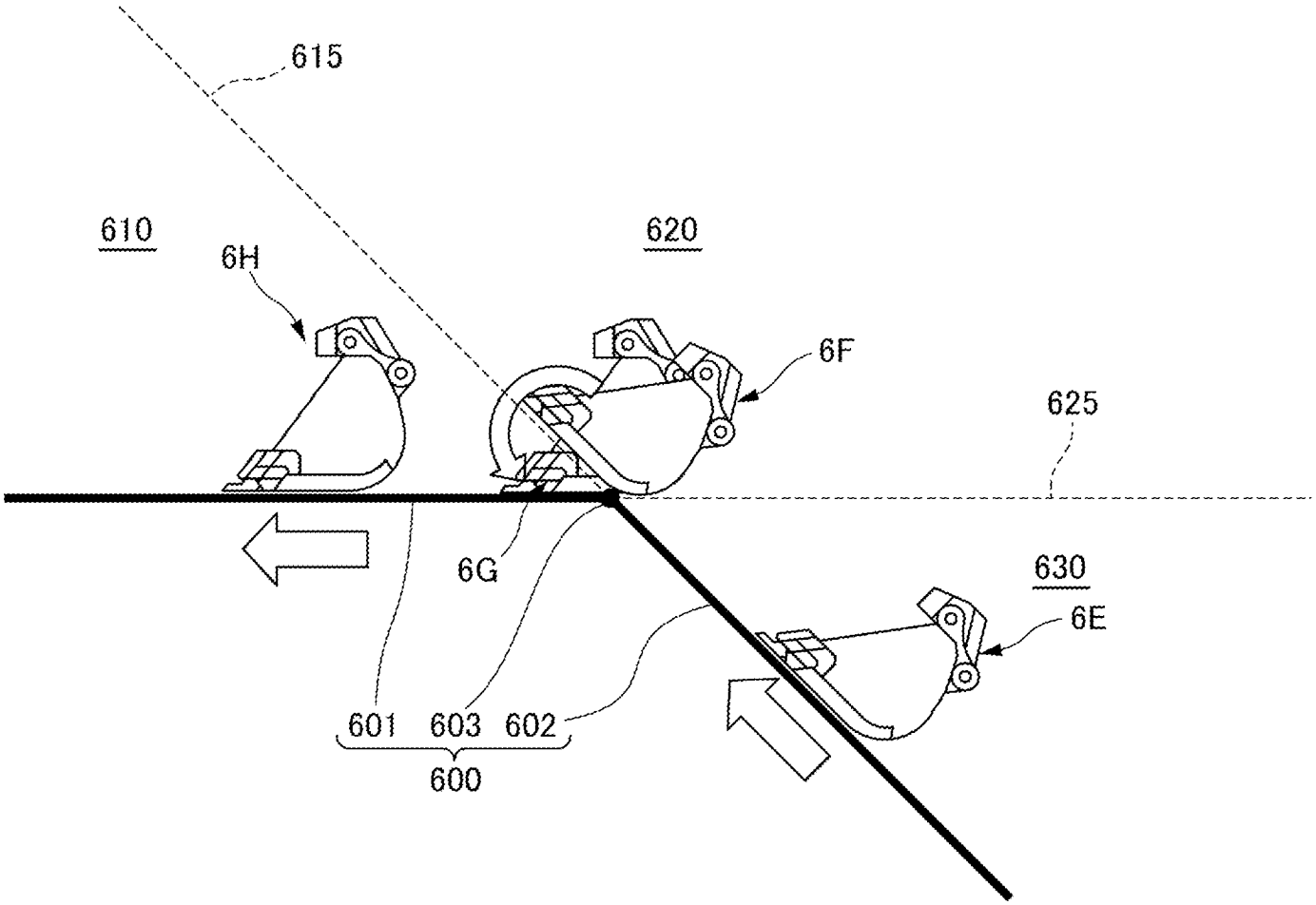
FIG. 7B is a diagram illustrating an example of a motion based on the machine control function of the shovel.

FIGS. 7A and 7B are diagrams illustrating examples of motions based on the machine control function of the shovel 100, showing a situation where the shovel 100 is performing leveling work (ground leveling work), moving the back surface 6_3 of the bucket 6 along an intended construction plane 600 with the machine control function.

In FIGS. 7A and 7B, of the attachment AT of the shovel 100, only the bucket 6 is depicted, and a depiction of the boom 4 and the arm 5 is omitted. Furthermore, in FIGS. 7A and 7B, in order to depict changes over time with the movement of the bucket 6, the bucket 6 is conveniently indicated by 6A, 6B, 6C, 6D, 6E, 6F, 6G and 6H at predetermined times.

As illustrated in FIGS. 7A and 7B, the intended construction plane 600 includes a horizontal plane 601 (a first intended construction plane), a slope 602 (a second intended construction plane) which is a downslope relative to the horizontal plane 601, and a bend 603 at which the horizontal plane 601 and the slope 602 intersect (a boundary portion of the intended construction plane).

Furthermore, a space above the intended construction plane 600 is divided into regions 610, 620 and 630 in accordance with the shape of the intended construction plane 600. Specifically, the region 610 is part of a spatial region above the horizontal plane 601 which part is on the horizontal plane 601 side (the left side in the drawing) of an extended plane 615 of the slope 602. The region 620 is part of a spatial region delimited by the extended plane 615 of the slope 602 and an extended plane 625 of the horizontal plane 601 above the bend 603. The region 630 is part of a spatial region above the slope 602 which part is on the slope 602 side (the lower side in the drawing) of the extended plane 625 of the horizontal plane 601. The regions 610 through 630 are preset based on the shape of the intended construction plane 600 in the shovel 100.

The method of setting (the method of delimiting) the regions 610 through 630 in FIGS. 7A and 7B is an example, and any setting method (delimiting method) may be adopted. The same applies to regions 810 through 830 of FIG. 9 described below.

The shovel 100 automatically moves the boom 4 and the bucket 6 according to the operator's operation of the arm 5 (hereinafter "arm operation") to move the bucket 6 such that the back surface 6_3 of the bucket 6 is aligned with the intended construction plane.

As illustrated in FIG. 7A, according to this example, with the machine body (the lower traveling structure 1 and the upper swing structure 3) being positioned on the horizontal plane 601 side, the shovel 100 moves the bucket 6, pushing the bucket 6 away from the machine body. Aligning the back surface 6_3 of the bucket 6 with the intended construction plane 600, the shovel 100 performs ground leveling work from the horizontal plane 601 (the state of a bucket 6A) to the bend 603 (the states of buckets 6B and 6C) and to the slope 602 (the state of a bucket 6D).

When the bucket 6 is positioned in the region 610 (the state of the bucket 6A), the controller 30 controls the bucket angle such that the back surface 6_3 of the bucket 6 parallels the horizontal plane 601 or maintains a predetermined angular range relative to parallelism to the horizontal plane 601. For example, the controller 30 may determine that the bucket 6 is positioned in the region 610 when at least part of the bucket 6 is included in the region 610. Furthermore, the controller 30 controls the boom angle such that the back surface 6_3 of the bucket 6 contacts (coincides with) the horizontal plane 601, based on the arm angle determined by the details of the arm operation and the bucket angle determined in relation to the horizontal plane 601. This enables the shovel 100 to move the bucket 6 along the horizontal plane 601.

When the position of the bucket 6 changes from being in the region 610 to being in the region 620 (the state of the bucket 6B), the controller 30 controls the bucket angle to change the state of the back surface 6_3 of the bucket 6 from being parallel to the horizontal plane 601 to being parallel to the slope 602. For example, the controller 30 may determine that the position of the bucket 6 is in the region 620 when the entirety of the bucket 6 is included in the region 620 and when the bucket 6 keeps on changing its pose as the bucket 6 enters the region 620. When at least a part of the bucket 6 that is the control reference is positioned in the region 620, the controller 30 may determine that the bucket 6 is positioned in the region 620. Furthermore, the controller 30 controls the boom angle based on the arm angle determined by the details of the arm operation and the bucket angle sequentially determined during the transition of the state of the bucket surface 6_3 of the bucket 6 from being parallel to the horizontal plane 601 to being parallel to the slope 602. For example, the controller 30 may control the boom angle such that the teeth tips 6_5 of the bucket 6 contact (coincide with) or are slightly spaced from the slope 602 or the extended plane 615 of the slope 602. This enables the shovel 100 to change the state of the back surface 6_3 of the bucket 6 from being parallel to the horizontal plane 601 (the state of the bucket 6B) to being parallel to the slope 602 (the state of the bucket 6C) while avoiding a situation where the bucket 6 bites the bend 603 or is out of alignment with the shape of the bend 603. Therefore, the shovel 100 can appropriately shape the intended construction plane 600 in the vicinity of the bend 603 with the back surface 6_3 of the bucket 6.

When the bucket 6 is positioned in the region 630 (the states of the buckets 6C and 6D), the controller 30 controls the bucket angle to keep the back surface 6_3 of the bucket 6 parallel to the slope 602. For example, the controller 30 may determine that the bucket 6 is positioned in the region 630 when the changing of the pose of the bucket 6, which starts in response to the entry of the bucket 6 into the region 620, is completed and at least part of the bucket 6 is included in the region 630. The controller 30 may also determine that the bucket 6 is positioned in the region 630 when at least a part of the bucket 6 that is the control reference is positioned in the region 630. Furthermore, the controller 30 controls the boom angle such that the back surface 6_3 of the bucket 6 contacts (coincides with) the slope 602, based on the arm angle determined by the details of the arm operation and the bucket angle determined in relation to the slope 602. This enables the shovel 100 to move the bucket 6 along the slope 602.

According to this example, first, the controller 30 controls the back surface 6_3 of the bucket 6 serving as the control reference (working part) such that the back surface 6_3 is aligned with the horizontal plane 601 as the target trajectory. In this case, the correspondence between the control reference and the target trajectory is set on the back surface 6_3 of the bucket 6 and the horizontal plane 601. At this point, the controller 30 determines the presence or absence of the bend 603 in the set intended construction plane 600, and in response to determining the presence of the bend 603, executes control that accommodates a change in the intended construction plane 600 at the bend 603.

According to this example, as illustrated in FIG. 7A, the change between the adjoining intended construction planes 600 (the horizontal plane 601 and the slope 602) at the bend 603 in the traveling direction of the control reference (working part) is more than 180°. In this case, the controller 30 determines whether the curve surface 6_2 of the bottom plate, which is the leading end of the bucket 6 in the traveling direction, has passed the extended plane 615 of the next intended construction plane (the slope 602). In response to determining that the curve surface 6_2 of the bucket 6 has passed the extended plane 615, the controller 30 further determines whether the teeth tips 6_5, which are the trailing end of the bucket 6 in the traveling direction, have passed the extended plane 615. In response to determining that the teeth tips 6_5 of the bucket 6 have passed the extended plane 615, the controller 30 changes the correspondence between the control reference and the target trajectory to the back surface 6_3 of the bucket 6 and the slope 602. Then, the controller 30 controls the bucket angle to change the state of the back surface 6_3 of the bucket 6 from being parallel to the horizontal plane 601 to being parallel to the slope 602. At this point, the bucket angle is controlled such that the back surface 6_3 of the bucket 6 parallels the slope 602 or is within a predetermined angular range relative to parallelism to the slope 602.

Thereafter, the controller 30 controls the back surface 6_3 of the bucket 6 serving as the control reference (working part) to be aligned with the slope 602 as the target trajectory.

Furthermore, as illustrated in FIG. 7B, according to this example, contrary to the case of FIG. 7A, with the machine body being positioned on the horizontal plane 601 side, the shovel 100 moves the bucket 6, drawing the bucket 6 toward the machine body. Aligning the back surface 6_3 of the bucket 6 with the intended construction plane 600, the shovel 100 performs ground leveling work from the slope 602 (the state of a bucket 6E) to the bend 603 (the states of buckets 6F and 6G) and to the horizontal plane 601 (the state of a bucket 6H).

When the bucket 6 is positioned in the region 630 (the state of the bucket 6E), the controller 30, the same as in the case of FIG. 7A, controls the bucket angle to keep the back surface 6_3 of the bucket 6 parallel to the slope 602. For example, the controller 30 may determine that the bucket 6 is positioned in the region 630 when at least part of the bucket 6 is included in the region 630. Furthermore, the controller 30, the same as in the case of FIG. 7A, controls the boom angle such that the back surface 6_3 of the bucket 6 contacts (coincides with) the slope 602, based on the arm angle determined by the details of the arm operation and the bucket angle determined in relation to the slope 602. This enables the shovel 100 to move the bucket 6 along the slope 602.

When the position of the bucket 6 changes from being in the region 630 to being in the region 620 (the state of the bucket 6F), the controller 30 controls the bucket angle to change the state of the back surface 6_3 of the bucket 6 from being parallel to the slope 602 to being parallel to the horizontal plane 601. Furthermore, the controller 30 controls the boom angle based on the arm angle determined by the details of the arm operation and the bucket angle sequentially determined during the transition of the state of the bucket surface 6_3 of the bucket 6 from being parallel to the slope 602 to being parallel to the horizontal plane 601. For example, the controller 30 may control the boom angle such that the back surface 6_3 of the bucket 6 contacts (coincides with) or is slightly spaced from the horizontal plane 601 or the extended plane 625 of the horizontal plane 601. This enables the shovel 100 to change the state of the back surface 6_3 of the bucket 6 from being parallel to the slope 602 (the state of the bucket 6F) to being parallel to the horizontal plane 601 (the state of the bucket 6G) while avoiding a situation where the bucket 6 bites the bend 603 or is out of alignment with the shape of the bend 603. Therefore, the shovel 100 can appropriately shape the intended construction plane 600 in the vicinity of the bend 603 with the back surface 6_3 of the bucket 6.

When the bucket 6 is positioned in the region 610 (the states of the buckets 6G and 6H), the controller 30 controls the bucket angle to keep the back surface 6_3 of the bucket 6 parallel to the horizontal plane 601. For example, the controller 30 may determine that the bucket 6 is positioned in the region 610 when the changing of the pose of the bucket 6, which starts in response to the entry of the bucket 6 into the region 620, is completed and at least part of the bucket 6 is included in the region 610. Furthermore, the controller 30 controls the boom angle such that the back surface 6_3 of the bucket 6 contacts (coincides with) the horizontal plane 601, based on the arm angle determined by the details of the arm operation and the bucket angle determined in relation to the horizontal plane 601. This enables the shovel 100 to move the bucket 6 along the horizontal plane 601.

According to this example, first, the controller 30 controls the back surface 6_3 of the bucket 6 serving as the control reference (working part) such that the back surface 6_3 is aligned with the slope 602 as the target trajectory. In this case, the correspondence between the control reference and the target trajectory is set on the back surface 6_3 of the bucket 6 and the slope 602. At this point, the controller 30 determines the presence or absence of the bend 603 in the set intended construction plane 600, and in response to determining the presence of the bend 603, executes control that accommodates a change in the intended construction plane 600 at the bend 603.

According to this example, as illustrated in FIG. 7B, the change between the adjoining intended construction planes 600 (the horizontal plane 601 and the slope 602) at the bend 603 in the traveling direction of the control reference (working part) is more than 180°. In this case, the controller 30 determines whether the teeth tips 6_5, which are the leading end of the bucket 6 in the traveling direction, has passed the extended plane 625 of the next intended construction plane (the horizontal plane 601). In response to determining that the teeth tips 6_5 of the bucket 6 have passed the extended plane 625, the controller 30 further determines whether the curved surface 6_2, which is the trailing end of the bucket 6 in the traveling direction, has passed the extended plane 625. In response to determining that the curved surface 6_2 of the bucket 6 has passed the extended plane 625, the controller 30 changes the correspondence between the control reference and the target trajectory to the back surface 6_3 of the bucket 6 and the horizontal plane 601. Then, the controller 30 controls the bucket angle to change the state of the back surface 6_3 of the bucket 6 from being parallel to the slope 602 to being parallel to the horizontal plane 601. At this point, the bucket angle is controlled such that the back surface 6_3 of the bucket 6 parallels the horizontal plane 601 or is within a predetermined angular range relative to parallelism to the horizontal plane 601.

Thereafter, the controller 30 controls the back surface 6_3 of the bucket 6 serving as the control reference (working part) to be aligned with the horizontal plane 601 as the target trajectory.

Thus, according to this example (FIGS. 7A and 7B), multiple regions (the regions 610 through 630) between which a control command for the motion of the bucket 6 (a bucket command value $\beta_{3r}$ as described below) generated by the controller 30 differs are set in the vicinity of the bend 603 of the intended construction plane 600. Specifically, when the bucket 6 is positioned in the region 610 or the region 630, the controller 30 generates a control command for the motion of the bucket 6 to keep the bucket angle parallel to the horizontal plane 601 or the slope 602. In contrast, when the position of the bucket 6 enters the region 620 from the region 610 or the region 630, the controller 30 generates a control command for the motion of the bucket 6 to change the bucket angle from being parallel to the horizontal plane 601 to being parallel to the slope 602 or from being parallel to the slope 602 to being parallel to the horizontal plane 601. More specifically, in a situation where the change between the adjoining intended construction planes 600 at the bend 603 in the traveling direction of the control reference (working part) is more than 180°, the controller 30 changes the correspondence between the control reference and the target trajectory when the trailing end of the bucket 6 in the traveling direction passes the extended plane of the next intended construction plane to enter. This enables the shovel 100 to avoid a situation where the bucket 6 bites the ground near the bend 603 or is out of alignment with the shape of the bend 603 to appropriately move the working part of the bucket 6 along the intended construction plane 600 in the vicinity of the bend 603 of the intended construction plane 600.

<Details of Configuration Related to Machine Control Function of Shovel>

Figure 8A:
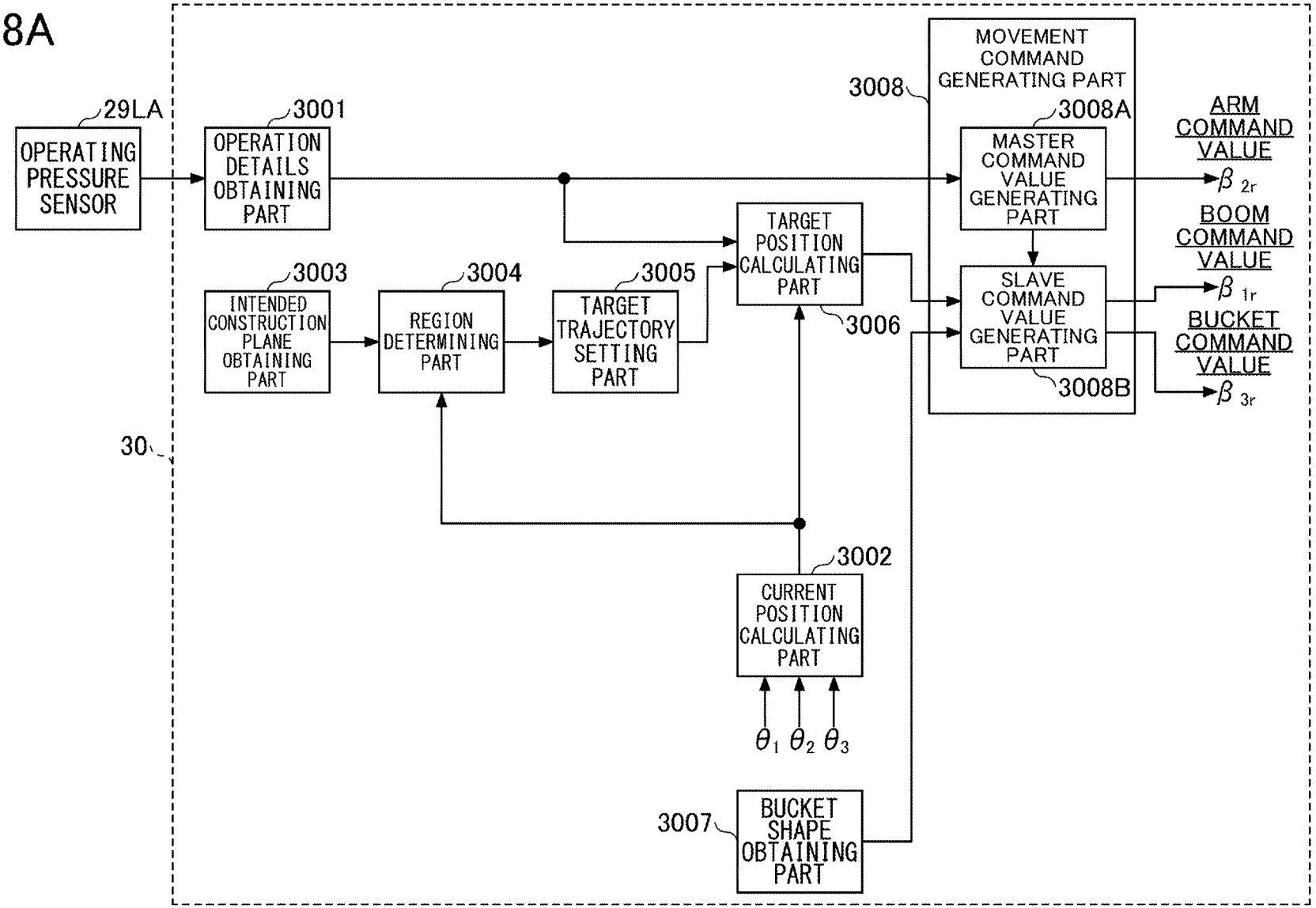
FIG. 8A is a functional block diagram illustrating an example of a detailed configuration related to the machine control function of the shovel.
Figure 8B:
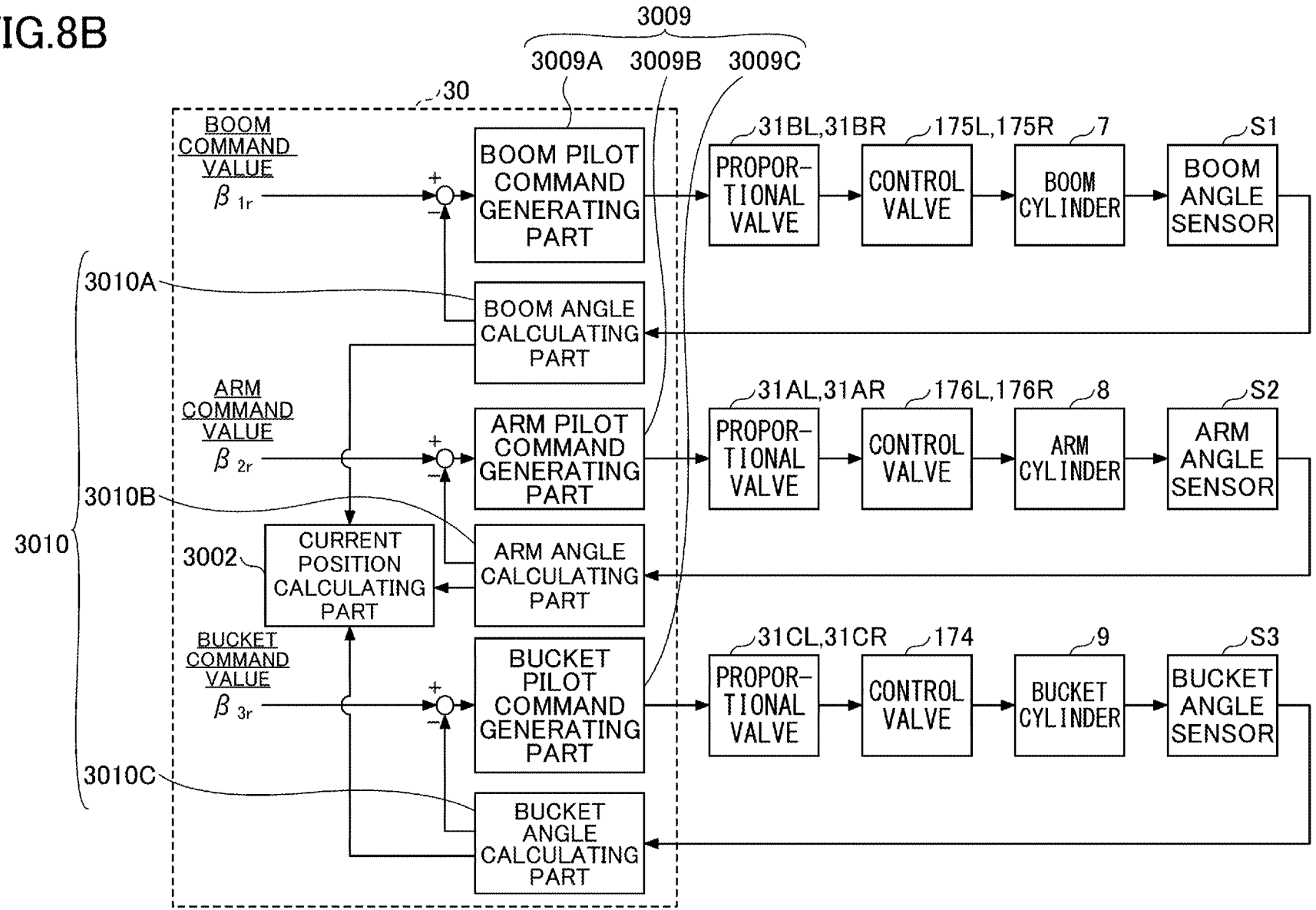
FIG. 8B is a functional block diagram illustrating an example of a detailed configuration related to the machine control function.

FIGS. 8A and 8B are functional block diagrams illustrating the details of an example of a configuration related to the machine control function of the shovel 100 according to this embodiment. Specifically, FIGS. 8A and 8B are a specific example of a configuration related to the machine control function for automatically moving the attachment AT of the shovel 100 in response to the operator's arm operation, namely, the forward and the backward operation of the left operating lever 26L.

A configuration related to the machine control function for automatically moving the attachment AT of the shovel 100 in response to arm remote control is the same as illustrated in FIGS. 8A and 8B except that the operating pressure sensor 29LA of FIG. 8A is replaced with a communications device that receives a remote control signal from an external apparatus. Accordingly, a description thereof is omitted.

The controller 30 includes an operation details obtaining part 3001, a current position calculating part 3002, an intended construction plane obtaining part 3003, a region determining part 3004, a target trajectory setting part 3005, a target position calculating part 3006, a bucket shape obtaining part 3007, a movement command generating part 3008, a pilot command generating part 3009, and a pose angle calculating part 3010 as functional parts related to the machine control function. For example, when the switch NS is pressed, these functional parts 3001 through 3010 repeatedly execute a below-described operation at predetermined control intervals.

The operation details obtaining part 3001 obtains operation details with respect to forward and backward tilting operations on the left operating lever 26L based on a detection signal fed from the operating pressure sensor 29LA. For example, the operation details obtaining part 3001 obtains (calculates) the direction of operation (whether it is a forward direction or a backward direction) and the amount of operation as operation details.

The current position calculating part 3002 calculates the position (current position) of the working part of the bucket 6 (for example, the teeth tips 6_5 or back surface 6_3 of the bucket 6). Specifically, the current position calculating part 3002 may calculate the current position of the control reference of the attachment AT based on a boom angle $\theta_1$, an arm angle $\theta_2$, and a bucket angle $\theta_3$ calculated by the below-described pose angle calculating part 3010.

The intended construction plane obtaining part 3003 obtains data on an intended construction plane from the internal memory (nonvolatile secondary storage) of the controller 30, a predetermined external storage, or the like, for example.

The region determining part 3004 determines a region in which the bucket 6 is positioned among regions preset in a space above the intended construction plane. When the intended construction plane includes a bend at which the inclination of a tangent plane discontinuously changes in the direction of the upper swing structure 3 (namely, the direction of the attachment AT), multiple regions for causing the bucket command value $\beta_{3r}$ to differ are set in the vicinity of the bend as described above. For example, the bend includes a part where planes of different inclinations intersect in the direction of the upper swing structure 3. Furthermore, the bend includes, for example, a part where a plane and a curved plane intersect and where the inclination of the plane to the tangent plane of the curved plane discontinuously changes in the direction of the upper swing structure 3. Furthermore, the bend includes, for example, a part where the inclination of the tangent plane of the intended construction plane formed of a curved plane discontinuously changes in the direction of the upper swing structure 3. For example, in the case of the intended construction plane 600, the regions 610 through 630 are set in a space above the intended construction plane 600 in the vicinity of the bend 603 as described above. In this case, as described above, the region determining part 3004 determines in which of the regions 610 through 630 the bucket 6 is positioned.

When the intended construction plane includes no bend, the process of the region determining part 3004 may be omitted.

The target trajectory setting part 3005 sets information on a target trajectory for the working part (control reference) of the bucket 6, such as the teeth tips 6_5 or the back surface 6_3, for moving the working part along the intended construction plane, based on the data on the intended construction plane. For example, the target trajectory setting part 3005 may set the inclination angle of the intended construction plane in the direction (namely, the longitudinal direction) of the upper swing structure 3 with reference to the machine body (the upper swing structure 3) of the shovel 100 as the information on the target trajectory for the working part of the bucket 6.

The target position calculating part 3006 calculates the target position of the working part (control reference) of the bucket 6 based on operation details (the direction of operation and the amount of operation) with respect to a forward or a backward operation on the left operating lever 26L, the set information on the target trajectory, and the current position of the working part of the bucket 6. Assuming that the arm 5 moves in response to the direction of operation and the amount of operation of the arm 5 on the left operating lever 26L, the target position is a position on the target trajectory (in other words, the intended construction plane) that should be a target to be reached during a current control period. The target position calculating part 3006 may, for example, calculate the target position of the working part of the bucket 6 using a map, an arithmetic expression or the like prestored in a secondary storage.

Furthermore, the target position calculating part 3006 calculates the target value of the bucket angle (hereinafter "target bucket angle") based on a region corresponding to the position of the bucket 6 determined by the region determining part 3004. For example, the target position calculating part 3006 calculates the target bucket angle corresponding to the back surface 6_3 of the bucket 6 parallel to the horizontal plane 601 based on data on the shape of the bucket 6 when the region determining part 3004 determines that the bucket 6 is in the region 610. Furthermore, for example, when the bucket 6 moves into the region 620 from the region 610 to be determined to be in the region 620 by the region determining part 3004, the target position calculating part 3006 calculates the bucket angle in a manner in which the back surface 6_3 of the bucket 6 sequentially changes its state from being parallel to the horizontal plane 601 to being parallel to the slope 602. The same is true for the case where the bucket 6 moves into the region 620 from the region 630 except that the start point and the end point of the changing of the bucket angle are reversed. Furthermore, for example, when the bucket 6 is determined to be in the region 630, the target position calculating part 3006 calculates the target bucket angle corresponding to the back surface 6_3 of the bucket 6 parallel to the slope 602 based on data on the shape of the bucket 6.

The bucket shape obtaining part 3007 obtains pre-recorded data on the shape of the bucket 6 from an internal memory (for example, a secondary storage), a predetermined external storage, or the like, for example. In this case, the bucket shape obtaining part 3007 may obtain data on the shape of the bucket 6 of a type set by a setting operation through the input device 72 from among pre-recorded data on the shapes of the multiple types of buckets 6.

The movement command generating part 3008 generates a command value $\beta_{1r}$ for the movement of the boom 4 (hereinafter "boom command value"), a command value $\beta_{2r}$ for the movement of the arm 5 (hereinafter "arm command value"), and the command value $\beta_{3r}$ for the movement of the bucket 6 (the bucket command value) based on the target position of the control reference in the attachment AT. For example, the boom command value $\beta_{1r}$, the arm command value $\beta_{2r}$, and the bucket command value $\beta_{3r}$ are a boom angle, an arm angle, and a bucket angle, respectively, at the time when the working part (control reference) of the bucket 6 reaches the target position. The movement command generating part 3008 includes a master command value generating part 3008A and a slave command value generating part 3008B.

The boom command value $\beta_{1r}$, the arm command value $\beta_{2r}$, and the bucket command value $\beta_{3r}$ may alternatively be the angular velocity of the boom 4 (hereinafter "boom angular velocity"), the angular velocity of the arm 5 (hereinafter "arm angular velocity"), and the angular velocity of the bucket 6 (hereinafter "bucket angular velocity") necessary for the working part (control reference) of the bucket 6 to reach the target position. Furthermore, the boom command value $\beta_{1r}$, the arm command value $\beta_{2r}$, and the bucket command value $\beta_{3r}$ may alternatively be angular accelerations or the like necessary for the working part (control reference) of the bucket 6 to reach the target position.

The master command value generating part 3008A generates the arm command value $\beta_{2r}$ for the movement of a master element (the arm 5) that is an object of the operator's operation among the constituent motion elements (the boom 4, the arm 5, and the bucket 6) of the attachment AT. The generated arm command value $\beta_{2r}$ is output to an arm pilot command generating part 3009B. Specifically, the master command value generating part 3008A generates the arm command value $\beta_{2r}$ corresponding to the operation details (the direction of operation and the amount of operation) of the left operating lever 26L. For example, the master command value generating part 3008A may generate the arm command value $\beta_{2r}$ based on a predetermined map, conversion equation, or the like that defines the relationship between the operation details of the left operating lever 26L and the arm command value $\beta_{2r}$.

Assuming that the operator operates the left operating lever 26L forward and backward, the master command value generating part 3008A may be omitted. This is because when the left operating lever 26L is operated forward or backward, a pilot pressure commensurate with the operation details is applied to the control valves 176L and 176R via the shuttle valve 32AL or 32AR as described above to allow the arm 5 to move as a master element.

The slave command value generating part 3008B generates command values for the movements of slave elements (the boom 4 and the bucket 6) (the boom command value $\beta_{1r}$ and the bucket command value $\beta_{3r}$) that operate in accordance with (namely, in synchronization with) the movement of the master element among the constituent motion elements of the attachment AT. The generated boom command value $\beta_{1r}$ and bucket command value $\beta_{3r}$ are output to a boom pilot command generating part 3009A and a bucket pilot command generating part 3009C, respectively. The slave command value generating part 3008B generates the boom command value $\beta_{1r}$ and the bucket command value $\beta_{3r}$ such that the slave elements move in accordance with (in synchronization with) the movement of the arm 5 corresponding to the arm command value $\beta_{2r}$ to allow the working part (control reference) of the bucket 6 to reach the target position (namely, to move along the intended construction plane). According to this, the controller 30 can move the working part (control reference) of the bucket 6 along the intended construction plane by moving the two slave elements (the boom 4 and the bucket 6) in accordance with (in synchronization with) the movement of the master element (the arm 5) corresponding to forward and backward operations on the left operating lever 26L.

The slave command value generating part 3008B first generates the bucket command value $\beta_{3r}$ corresponding to the pose of the bucket 6 (the bucket angle) at the target position of the working part of the bucket 6. That is, the slave command value generating part 3008B generates the bucket command value $\beta_{3r}$ corresponding to the target bucket angle. For example, when the bucket 6 is positioned in the region 610 or the region 630, the slave command value generating part 3008B generates the bucket command value $\beta_{3r}$ such that the back surface 6_3 of the bucket 6 is parallel to the horizontal plane 601 or the slope 602. Furthermore, in response to the entry of the bucket 6 into the region 620 from the region 610 or the region 630, the slave command value generating part 3008B generates the bucket command value $\beta_{3r}$ corresponding to the sequentially changing bucket angle during the transition of the state of the back surface 6_3 of the bucket 6 from being parallel to the horizontal plane 601 to being parallel to the slope 602 or from being parallel to the slope 602 to being parallel to the horizontal plane 601. Then, the slave command value generating part 3008B generates the boom command value $\beta_{1r}$ such that the working part of the bucket 6 reaches the target position, based on the generated arm command value $\beta_{2r}$ and bucket command value $\beta_{3r}$.

The pilot command generating part 3009 generates command values for pilot pressures to be applied to the control valves 174 through 176 (hereinafter "pilot pressure command values") for achieving the boom angle, the arm angle, and the bucket angle corresponding to the boom command value $\beta_{1r}$, the arm command value $\beta_{2r}$, and the bucket command value $\beta_{3r}$. The pilot command generating part 3009 includes the boom pilot command generating part 3009A, the arm pilot command generating part 3009B, and the bucket pilot command generating part 3009C.

The boom pilot command generating part 3009A generates a pilot pressure command value to be applied to the control valves 175L and 175R corresponding to the boom cylinder 7 that drives the boom 4, based on the difference between the boom command value $\beta_{1r}$ and the value of the current boom angle calculated (measured) by a boom angle calculating part 3010A described below. Then, the boom pilot command generating part 3009A outputs a control current commensurate with the generated pilot pressure command value to the proportional valve 31BL or 31BR. As a result, as described above, a pilot pressure commensurate with the pilot pressure command value output from the proportional valve 31BL or 31BR is applied to corresponding pilot ports of the control valves 175L and 175R via the shuttle valve 32BL or 32BR. Then, through the operations of the control valves 175L and 175R, the boom cylinder 7 operates, so that the boom 4 moves to achieve the boom angle corresponding to the boom command value $\beta_{1r}$.

The arm pilot command generating part 3009B generates a pilot pressure command value to be applied to the control valves 176L and 176R corresponding to the arm cylinder 8 that drives the arm 5, based on the difference between the arm command value $\beta_{2r}$ and the value of the current arm angle calculated (measured) by an arm angle calculating part 3010B described below. Then, the arm pilot command generating part 3009B outputs a control current commensurate with the generated pilot pressure command value to the proportional valve 31AL or 31AR. As a result, as described above, a pilot pressure commensurate with the pilot pressure command value output from the proportional valve 31AL or 31AR is applied to corresponding pilot ports of the control valves 176L and 176R via the shuttle valve 32AL or 32AR. Then, through the operations of the control valves 176L and 176R, the arm cylinder 8 operates, so that the arm 5 moves to achieve the arm angle corresponding to the arm command value $\beta_{2r}$.

The bucket pilot command generating part 3009C generates a pilot pressure command value to be applied to the control valve 174 corresponding to the bucket cylinder 9 that drives the bucket 6, based on the difference between the bucket command value $\beta_{3r}$ and the value of the current bucket angle calculated (measured) by a bucket angle calculating part 3010C described below. Then, the bucket pilot command generating part 3009C outputs a control current commensurate with the generated pilot pressure command value to the proportional valve 31CL or 31CR. As a result, as described above, a pilot pressure commensurate with the pilot pressure command value output from the proportional valve 31CL or 31CR is applied to a corresponding pilot port of the control valve 174 via the shuttle valve 32CL or 32CR. Then, through the operation of the control valve 174, the bucket cylinder 9 operates, so that the bucket 6 operates to achieve the bucket angle corresponding to the bucket command value $\beta_{3r}$.

The pose angle calculating part 3010 calculates (measures) the (current) boom angle, arm angle, and bucket angle, etc., based on detection signals of the boom angle sensor S1, the arm angle sensor S2, and the bucket angle sensor S3. The pose angle calculating part 3010 includes the boom angle calculating part 3010A, the arm angle calculating part 3010B, and the bucket angle calculating part 3010C.

The boom angle calculating part 3010A calculates (measures) the boom angle, etc., based on a detection signal fed from the boom angle sensor S1.

The arm angle calculating part 3010B calculates (measures) the arm angle, etc., based on a detection signal fed from the arm angle sensor S2.

The bucket angle calculating part 3010C calculates (measures) the bucket angle, etc., based on a detection signal fed from the bucket angle sensor S3.

Thus, according to this embodiment, multiple regions between which a control command (the bucket command value $\beta_{3r}$ for the movement of the bucket 6 generated by the controller 30 differs are set in the vicinity of a bend of an intended construction plane. Specifically, a region (for example, the region 610) corresponding to a first part of the intended construction surface (for example, the horizontal plane 601) bordering on the bend (for example, the bend 603), a region (for example, the region 620) corresponding to the bend, and a region (for example, the region 630)

corresponding to a second part of the intended construction surface (for example, the slope 602) bordering on the bend are set.

This enables the shovel 100 to control the bucket 6 differently between the multiple regions so that the working part of the bucket 6 appropriately moves along the intended construction plane. In particular, in the region corresponding to the bend, it is possible to appropriately change the pose of the bucket 6 (change the bucket angle) as required with the movement of the bucket 6 between the first part of the intended construction plane and the second part of the intended construction plane whose boundary is the bend. Therefore, the shovel 100 can avoid a situation where the bucket 6 bites the bend 603 or is out of alignment with the shape of the bend 603 and appropriately shape the intended construction plane 600 in the vicinity of the bend 603 with the working part of the bucket 6.

Furthermore, when the position of the bucket 6 moves from a first region into a second region among the set regions, the controller 30 may generate a control command for the movement of the bucket 6 corresponding to the second region. For example, in response to the entry of the bucket 6 into the region 620 from the region 610 or the region 630, the controller 30 generates a control command corresponding to the region 620, namely, a control command for the movement of the bucket 6 for changing the state of the back surface 6_3 of the bucket 6 from being parallel to the horizontal plane 601 to being parallel to the slope 602 or from being parallel to the slope 602 to being parallel to the horizontal plane 601. Furthermore, for example, in response to the entry of the bucket 6 into the region 610 from the region 620, the controller 30 generates a control command corresponding to the region 610, namely, a control command for the movement of the bucket 6 for keeping the back surface 6_3 of the bucket 6 parallel to the horizontal plane 601. Furthermore, for example, in response to the entry of the bucket 6 into the region 630 from the region 620, the controller 30 generates a control command corresponding to the region 630, namely, a control command for the movement of the bucket 6 for keeping the back surface 6_3 of the bucket 6 parallel to the slope 602.

This enables the shovel 100 to cause the mode of controlling the bucket 6 to specifically differ between the multiple regions.

Furthermore, the controller 30 may generate a control command for the movement of the boom 4 (the boom command value $\beta_{1r}$) based on a control command for the movement of the bucket 6 (the bucket command value $\beta_{3r}$). Specifically, the controller 30 may generate a control command for the movement of the boom 4 based on a control command for the movement of the arm 5 corresponding to the arm operation (the arm command value $\beta_{2r}$) and a control command for the movement of the bucket 6 that is generated earlier. The controller 30, for example, may generate a control command for the movement of the bucket 6 earlier to achieve the target pose of the bucket 6 (the target bucket angle) relative to the intended construction plane.

This enables the controller 30 to control the working part of the bucket 6 to move along the intended construction plane by determining the movement of the boom 4 based on the movement of the arm 5 corresponding to the arm operation and the movement of the bucket 6 determined earlier.

<Another Specific Example of Motion Based on Machine Control Function of Shovel>

Figure 9:
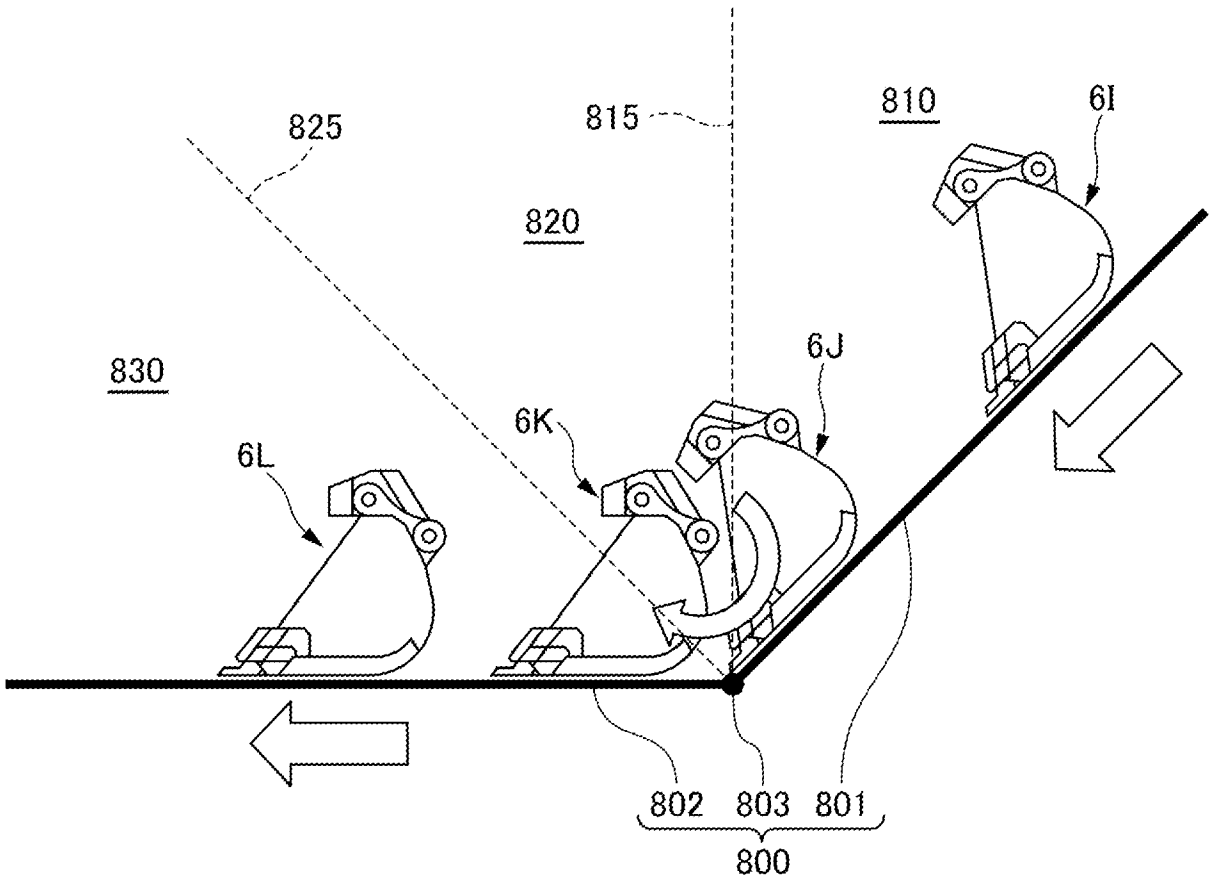
FIG. 9 is a diagram illustrating another example of a motion based on the machine control function of the shovel.

FIG. 9 is a diagram illustrating another example of a motion based on the machine control function of the shovel 100, showing a situation where the shovel 100 is performing leveling work (ground leveling work), moving the back surface 6_3 of the bucket 6 along an intended construction plane 800 with the machine control function.

In FIG. 9, of the attachment AT of the shovel 100, only the bucket 6 is depicted, and a depiction of the boom 4 and the arm 5 is omitted. Furthermore, in FIG. 9, in order to depict changes over time with the movement of the bucket 6, the bucket 6 is conveniently indicated by 6I, 6J, 6K and 6L at predetermined times.

As illustrated in FIG. 9, the intended construction plane 800 includes a slope 801 (a first intended construction plane), a horizontal plane 802 (a second intended construction plane) positioned on the base side of the slope 801, and a bend 803 at which the slope 801 and the horizontal plane 802 intersect (a boundary portion of the intended construction plane).

Furthermore, a space above the intended construction plane 800 is divided into the regions 810, 820 and 830 in accordance with the shape of the intended construction plane 800. Specifically, the region 810 is part of a spatial region above the slope 801 which part is on the slope 801 side (the right side in the drawing) of a vertical plane 815 that passes through the bend 803 and is perpendicular to the horizontal plane 802. The region 820 is part of a spatial region delimited by the vertical plane 815 and a vertical plane 825 perpendicular to the slope 801 above the bend 803. The region 830 is part of a spatial region above the horizontal plane 802 which part is on the horizontal plane 802 side (the left side in the drawing) of the vertical plane 825. The regions 810 through 830 are preset based on the shape of the intended construction plane 800 in the shovel 100.

The same as in the specific examples of FIGS. 7A and 7B, the shovel 100 automatically moves the boom 4 and the bucket 6 according to the operator's operation of the arm 5 (hereinafter "arm operation") to move the bucket 6 such that the back surface 6_3 of the bucket 6 is aligned with the intended construction plane.

According to this example, with the machine body being positioned on the horizontal plane 802 side, the shovel 100 moves the bucket 6, drawing the bucket 6 toward the machine body. Aligning the back surface 6_3 of the bucket 6 with the intended construction plane 800, the shovel 100 performs ground leveling work from the slope 801 (the state of a bucket 6I) to the bend 803 (the states of buckets 6J and 6K) and to the horizontal plane 802 (the state of a bucket 6L).

When the bucket 6 is positioned in the region 810 (the state of the bucket 6I), the controller 30 controls the bucket angle to keep the back surface 6_3 of the bucket 6 parallel to the slope 801. For example, the controller 30 may determine that the bucket 6 is positioned in the region 810 when the entirety of the bucket 6 is included in the region 810. Furthermore, the controller 30 controls the boom angle such that the back surface 6_3 of the bucket 6 contacts (coincides with) the slope 801, based on the arm angle determined by the details of the arm operation and the bucket angle determined in relation to the slope 801. This enables the shovel 100 to move the bucket 6 along the slope 801.

When the position of the bucket 6 changes from being in the region 810 to being in the region 820 (the state of the bucket 6J), the controller 30 controls the bucket angle to change the state of the back surface 6_3 of the bucket 6 from being parallel to the slope 801 to being parallel to the horizontal plane 802. For example, the controller 30 may determine that the bucket 6 is positioned in the region 820 when at least part of the bucket 6 is included in the region 820 and when the bucket 6 keeps on changing its pose as the bucket 6 enters the region 820. Furthermore, the controller 30 controls the boom angle based on the arm angle determined by the details of the arm operation and the bucket angle sequentially determined during the transition of the state of the bucket surface 6_3 of the bucket 6 from being parallel to the slope 801 to being parallel to the horizontal plane 802. This enables the shovel 100 to appropriately shape the intended construction plane 800 in the vicinity of the bend 803 with the back surface 6_3 of the bucket 6.

When the bucket 6 is positioned in the region 830 (the states of the buckets 6J and 6K), the controller 30 controls the bucket angle to keep the back surface 6_3 of the bucket 6 parallel to the horizontal plane 802. For example, the controller 30 may determine that the bucket 6 is positioned in the region 830 when the changing of the pose of the bucket 6, which starts in response to the entry of the bucket 6 into the region 820, is completed and at least part of the bucket 6 is included in the region 830. Furthermore, the controller 30 controls the boom angle such that the back surface 6_3 of the bucket 6 contacts (coincides with) the horizontal plane 802, based on the arm angle determined by the details of the arm operation and the bucket angle determined in relation to the horizontal plane 802. This enables the shovel 100 to move the bucket 6 along the horizontal plane 802.

According to this example, first, the controller 30 controls the back surface 6_3 of the bucket 6 serving as the control reference (working part) such that the back surface 6_3 is aligned with the slope 801 as the target trajectory. In this case, the correspondence between the control reference and the target trajectory is set on the back surface 6_3 of the bucket 6 and the slope 801. At this point, the controller 30 determines the presence or absence of the bend 803 in the set intended construction plane 800, and in response to determining the presence of the bend 803, executes control that accommodates a change in the intended construction plane 800 at the bend 803.

According to this example, as illustrated in FIG. 9, the change between the adjoining intended construction planes 800 at the bend 803 in the traveling direction of the control reference (working part) is less than 180°. In this case, the controller 30 determines whether the teeth tips 6_5, which are the leading end of the bucket 6 in the traveling direction, have reached a bent portion (the bend 803) to the next intended construction plane (the horizontal plane 802). In response to determining that the teeth tips have reached the bend, the controller 30 changes the correspondence between the control reference and the target trajectory to the back surface 6_3 of the bucket 6 and the horizontal plane 802. Then, the controller 30 controls the bucket angle to change the state of the back surface 6_3 of the bucket 6 from being parallel to the slope 801 to being parallel to the horizontal plane 802. At this point, the bucket angle is controlled such that the back surface 6_3 of the bucket 6 parallels the horizontal plane 802 or is within a predetermined angular range relative to parallelism to the horizontal plane 802.

Thereafter, the controller 30 controls the back surface 6_3 of the bucket 6 serving as the control reference (working part) to be aligned with the horizontal plane 802 as the target trajectory.

Furthermore, the same as in the specific example of FIG. 7A, with the machine body being positioned on the horizontal plane 802 side, the shovel 100 may move the bucket 6, pushing the bucket 6 away from the machine body. In this case, aligning the back surface 6_3 of the bucket 6 with the intended construction plane 800, the shovel 100 performs ground leveling work from the horizontal plane 802 (the state of the bucket 6L) to the bend 803 (the states of the buckets 6K and 6J) and to the slope 801 (the state of the bucket 6I).

When the bucket 6 is positioned in the region 830 (the state of the bucket 6L), the controller 30 controls the bucket angle to keep the back surface 6_3 of the bucket 6 parallel to the horizontal plane 802. For example, the controller 30 may determine that the bucket 6 is positioned in the region 830 when the entirety of the bucket 6 is included in the region 830. Furthermore, the same as in the case of FIG. 9, the controller 30 controls the boom angle such that the back surface 6_3 of the bucket 6 contacts (coincides with) the horizontal plane 802, based on the arm angle determined by the details of the arm operation and the bucket angle determined in relation to the horizontal plane 802. This enables the shovel 100 to move the bucket 6 along the horizontal plane 802.

When the position of the bucket 6 changes from being in the region 830 to being in the region 820 (the state of the bucket 6K), the controller 30 controls the bucket angle to change the state of the back surface 6_3 of the bucket 6 from being parallel to the horizontal plane 802 to being parallel to the slope 801. Furthermore, the controller 30 controls the boom angle based on the arm angle determined by the details of the arm operation and the bucket angle sequentially determined during the transition of the state of the bucket surface 6_3 of the bucket 6 from being parallel to the horizontal plane 802 to being parallel to the slope 801. This enables the shovel 100 to appropriately shape the intended construction plane 800 in the vicinity of the bend 803 with the back surface 6_3 of the bucket 6.

When the bucket 6 is positioned in the region 810 (the states of the buckets 6J and 6I), the controller 30 controls the bucket angle to keep the back surface 6_3 of the bucket 6 parallel to the slope 801. For example, the controller 30 may determine that the bucket 6 is positioned in the region 810 when the changing of the pose of the bucket 6, which starts in response to the entry of the bucket 6 into the region 820, is completed and at least part of the bucket 6 is included in the region 810. Furthermore, the controller 30 controls the boom angle such that the back surface 6_3 of the bucket 6 contacts (coincides with) the slope 801, based on the arm angle determined by the details of the arm operation and the bucket angle determined in relation to the slope 801. This enables the shovel 100 to move the bucket 6 along the slope 801.

Thus, according to this example, the same as in the specific examples of FIGS. 7A and 7B, multiple regions (the regions 810 through 830) between which a control command for the movement of the bucket 6 (the bucket command value $\beta_{3r}$) generated by the controller 30 differs are set in the vicinity of the bend 803 of the intended construction plane 800. Specifically, when the bucket 6 is positioned in the region 810 or the region 830, the controller 30 generates a control command for the movement of the bucket 6 to keep the bucket angle parallel to the slope 801 or the horizontal plane 802. In contrast, when the position of the bucket 6 enters the region 820 from the region 810 or the region 830, the controller 30 generates a control command for the movement of the bucket 6 to change the bucket angle from being parallel to the slope 801 to being parallel to the horizontal plane 802 or from being parallel to the horizontal plane 802 to being parallel to the slope 801. This enables the shovel 100 to appropriately move the working part of the bucket 6 along the intended construction plane 800 in the vicinity of the bend 803 of the intended construction plane 800, the same as in the specific examples of FIGS. 7A and 7B. [Operation] According to this embodiment, as the control reference (working part) moves, the controller 30 switches the correspondence between the control reference (working part) and the target trajectory (intended construction plane) at a bent portion on the target trajectory. Specifically, the controller 30 may change the manner of switching the correspondence between the control reference (working part) and the target trajectory (the intended construction plane) according to how the target trajectory changes at the bent portion (bend). For example, when the change between adjoining intended construction planes at the bend is less than 180°, the controller 30 may switch the correspondence between the control reference and the target trajectory to the next target trajectory (intended construction plane) in response to the leading end of the end attachment along the target trajectory arriving at the bend. In contrast, for example, when the change between adjoining intended construction planes at the bend is more than 180°, the controller 30 may switch the correspondence between the control reference and the target trajectory to the next target trajectory (intended construction plane) in response to the trailing end of the end attachment along the target trajectory passing the extended plane of the next target trajectory at the bend.

This enables the controller 30 to appropriately cause the control reference (working part) of the end attachment to perform tracking according to a change in the target trajectory (intended construction plane) at the bent portion (bend).

VARIATIONS AND MODIFICATIONS

An embodiment is described in detail above. The present disclosure, however, is not limited to the specifically disclosed embodiment, and variations and modifications may be made without departing from the scope of the present disclosure.

For example, while the shovel 100 moves the working part of the bucket 6 along the intended construction plane with the machine control function (semi-automatic operation function) according to the above-described embodiment, the bucket 6 may be similarly moved by a complete automatic operation function or an autonomous operation function.

Furthermore, according to the above-described embodiment, the shovel 100 is configured such that various motion elements such as the lower traveling structure 1, the upper swing structure 3, the boom 4, the arm 5, and the bucket 6 are all hydraulically driven. The shovel 100, however, may also be configured such that one or more of them are electrically driven. That is, according to the above-described embodiment, one or more of the driven elements of the shovel 100 may be driven by electric actuators (for example, an electric motor, etc.).

What is claimed is:

1. A shovel comprising:

an attachment including a boom, an arm, and a bucket; and a hardware processor configured to move the attachment to move a back surface of the bucket along an intended construction plane, wherein a plurality of regions between which a control command for a movement of the bucket generated by the hardware processor differs are set at a bend of the intended construction plane, wherein the hardware processor is further configured to control movement of the back surface of the bucket at the bend, wherein the hardware processor is configured to:

determine whether a leading end of the bucket along the target trajectory arrives at the bend;

determine whether a change between adjoining intended construction planes at the bend is less than 180°, determine whether a trailing end of the bucket along the target trajectory passes an extended plane of the next target trajectory at the bend, determine whether the change between adjoining intended construction planes at the bend is more than 180°, wherein the hardware processor is configured to:

obtain shape data of the bucket from an internal memory, or a predetermined external storage, and determine whether the leading end of the bucket along the target trajectory arrives at the bend based on the shape data of the bucket, wherein the hardware processor is configured to sequentially change a pose of the back surface of the bucket from being parallel to a first adjoining intended construction plane to being parallel to a second adjoining intended construction plane, wherein the hardware processor is configured to switch a correspondence between a control reference and a target trajectory to a next target trajectory in response to determining that the leading end of the bucket along the target trajectory arriving at the bend upon the determination that the change between the first and second adjoining intended construction planes at the bend is less than 180°, and wherein the hardware processor is configured to switch the correspondence between the control reference and the target trajectory to the next target trajectory in response to the trailing end of the bucket along the target trajectory passing the extended plane of the next target trajectory at the bend upon the determination that the change between the first and second adjoining intended construction planes at the bend is more than 180°.

2. The shovel as claimed in claim 1, wherein the hardware processor is configured to, upon determining that the bucket enters into a second region from a first region among the plurality of regions, generate the control command for the movement of the bucket corresponding to the second region.

3. The shovel as claimed in claim 2, wherein the hardware processor is configured to move the boom and the bucket to move the back surface of the bucket along the intended construction plane according to an operation of the arm, and to generate a control command for a movement of the boom based on the control command for the movement of the bucket.

4. A controller for a shovel, the shovel including an attachment including a boom, an arm, and a bucket, the controller comprising:

a hardware processor configured to move the attachment to move a back surface of the bucket along an intended construction plane, wherein a plurality of regions between which a control command for a movement of the bucket generated by the hardware processor differs are set at a bend of the intended construction plane, wherein the hardware processor is further configured to control movement of the back surface of the bucket at the bend, wherein the hardware processor is configured to:

determine whether a leading end of the bucket along the target trajectory arrives at the bend;

determine whether a change between adjoining intended construction planes at the bend is less than 180°, determine whether a trailing end of the bucket along the target trajectory passes an extended plane of the next target trajectory at the bend, determine whether the change between the adjoining intended construction planes at the bend is more than 180°, wherein the hardware processor is configured to:

obtain shape data of the bucket from an internal memory, or a predetermined external storage, and determine whether the leading end of the bucket along the target trajectory arrives at the bend based on the shape data of the bucket, wherein the hardware processor is configured to sequentially change a pose of the back surface of the bucket from being parallel to a first adjoining intended construction plane to being parallel to a second adjoining intended construction plane, wherein the hardware processor is configured to switch a correspondence between a control reference and a target trajectory to a next target trajectory in response to the leading end of the bucket along the target trajectory arriving at the bend upon the determination that the change between adjoining intended construction planes at the bend is less than 180°, and wherein the hardware processor is configured to switch the correspondence between the control reference and the target trajectory to the next target trajectory in response to the trailing end of the bucket along the target trajectory passing the extended plane of the next target trajectory at the bend upon the determination that the change between the first and second adjoining intended construction planes at the bend is more than 180°.

5. The controller as claimed in claim 4, wherein the hardware processor is configured to, upon determining that the bucket enters into a second region from a first region among the plurality of regions, generate the control command for the movement of the bucket corresponding to the second region.

6. The controller as claimed in claim 5, wherein the hardware processor is configured to move the boom and the bucket to move the back surface of the bucket along the intended construction plane according to an operation of the arm, and to generate a control command for a movement of the boom based on the control command for the movement of the bucket.

7. The shovel as claimed in claim 1, wherein the hardware processor is configured to continue to control the movement of the back surface of the bucket as the working part of the bucket approaches and moves away from the bend.

8. The shovel as claimed in claim 7, wherein the hardware processor is configured to continue to control the movement of the working part of the bucket so as to keep the back surface of the bucket to be parallel to the intended construction plane as the working part of the bucket approaches and moves away from the bend.

9. The shovel as claimed in claim 1, wherein the hardware processor is configured to switch the leading end between one end and an opposite end of the bucket as switching a moving direction of the bucket between a direction toward the shovel and a direction away from the shovel.

10. The shovel as claimed in claim 1, wherein the hardware processor is configured to generate a bucket command value corresponding to a target bucket angle such that the hardware processor sequentially changes the pose of the back surface of the bucket from being parallel to the first adjoining intended construction plane to being parallel to the second adjoining intended construction plane, and generate a boom command value based on the generated bucket command value and an arm operation.

11. The shovel as claimed in claim 1, wherein the hardware processor is configured to determine a transition region in the vicinity of the bend based on the shape data, and initiate the sequential change of the pose of the back surface of the bucket within the transition region such that the back surface is aligned with the second adjoining intended construction plane at a timing synchronized with the switch of the correspondence.

* * * * *